US007213986B2

(12) United States Patent
Watanabe et al.

(10) Patent No.: US 7,213,986 B2
(45) Date of Patent: May 8, 2007

(54) PRINTER APPARATUS

(75) Inventors: Sumio Watanabe, Shinagawa (JP); Fumio Sakurai, Shinagawa (JP); Yukihiro Mori, Shinagawa (JP); Kunihiko Funada, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/828,238

(22) Filed: Apr. 21, 2004

(65) Prior Publication Data

US 2005/0095047 A1 May 5, 2005

(30) Foreign Application Priority Data

Oct. 29, 2003 (JP) ..... 2003-369318

(51) Int. Cl.
*B41J 11/20* (2006.01)

(52) U.S. Cl. ..... 400/55; 400/56; 400/58

(58) Field of Classification Search ..... 400/55, 400/58

See application file for complete search history.

(56) References Cited

U.S. PATENT DOCUMENTS

| | | | | |
|---|---|---|---|---|
| 5,014,073 | A * | 5/1991 | Sone et al. | 347/198 |
| 5,481,352 | A | 1/1996 | Yamamoto et al. | 355/308 |
| 5,535,671 | A * | 7/1996 | Kanno | 101/116 |
| 5,818,487 | A | 10/1998 | Yoshimura et al. | |
| 6,007,063 | A | 12/1999 | Park | |
| 6,293,670 | B1 * | 9/2001 | Taniguro et al. | 347/104 |
| 6,511,237 | B1 | 1/2003 | Fujiwara | |
| 2001/0022427 | A1 * | 9/2001 | Ito | 271/272 |
| 2003/0081100 | A1 | 5/2003 | Rasmussen et al. | |

FOREIGN PATENT DOCUMENTS

| | | |
|---|---|---|
| EP | 0 908 6002 | 3/1997 |
| EP | 0 832 753 | 4/1998 |
| EP | 0 889 451 | 1/1999 |
| JP | 6-246943 | 9/1994 |
| JP | 7-300257 | 11/1995 |

(Continued)

OTHER PUBLICATIONS

Copy of Chinese Patent Office Action dated Jun. 23, 2006 for corresponding Chinese Patent Application No. 200410043264.1.

(Continued)

*Primary Examiner*—Daniel J. Colilla
*Assistant Examiner*—Marissa Ferguson-Samreth
(74) *Attorney, Agent, or Firm*—Staas & Halsey LLP

(57) ABSTRACT

A printer apparatus for printing data on paper traveling through the printer apparatus in a paper conveying direction. The printer apparatus includes a paper conveying portion including a driving roller and a driven roller, the driving roller and driven roller being moveable with respect to one another between an engaged position at which the driving roller and the driven roller are pressed together and a disengaged position at which the driving roller and the driven roller are separated; wherein the paper conveying portion is situated downstream, with respect to the paper conveying direction, from the location at which the data is printed on the paper; and wherein the driving roller and the driven roller are operative to pressingly sandwich the paper therebetween when the driving roller and the driven roller are in the engaged position.

20 Claims, 19 Drawing Sheets

FOREIGN PATENT DOCUMENTS

| | | | |
|---|---|---|---|
| JP | 9-86002 | | 3/1997 |
| JP | 2001-096823 | | 4/2001 |
| JP | 2001-106407 | * | 4/2001 |
| JP | 2002-120389 | | 4/2002 |
| JP | 2003-237160 | | 8/2003 |
| KR | 1999-87603 | | 12/1999 |

OTHER PUBLICATIONS

Korean Patent Office Action, dated Jan. 16, 2007, and issued in Korean Patent Application No. 10-2006-0039820.

* cited by examiner

S90
SET PAPER
S91
OBTAIN PAPER POSITION
S92
PRINT
S93
CUT PAPER 12
64(64a,64b,64c)
11
61
81
A1
A2
40
(42,43)
32
31
ON
OFF
81a
82
68

PRINTER APPARATUS

BACKGROUND OF THE INVENTION

1. Field of the Invention

The present invention generally relates to a printer apparatus, and more particularly to a portable thermal printer apparatus having a first module detachably attached to a second module.

2. Description of the Related Art

In recent years, there is a growing demand for portable thermal printers that can print, for example, barcodes and meter readouts. Compared to a general printer, a higher printing precision with respect to a paper conveying direction is required since barcodes and meter readouts are read by OCR (Optical Character Recognition).

With a conventional portable thermal printer of a clamshell type, when a cover of the printer is closed, a platen roller formed of rubber, holding a sheet of paper, presses against a thermal head. The platen roller is rotated by a motor, and the paper is fed by the frictional force of the platen roller. A conventional example is shown in Japanese Laid-Open Patent Application No.2002-120389.

Owing that the platen roller presses against the thermal head, the platen roller is generally formed of rubber. Although a satisfactory performance may be obtained in the early periods of using the rubber platen rollers, it is difficult to maintain such performance for a long period due to such factors as, for example, expansion/contraction caused from heat, deterioration with age, or wear.

SUMMARY OF THE INVENTION

It is a general object of the present invention to provide a printer apparatus that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a printer particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a printer apparatus for printing data on paper traveling through the printer apparatus in a paper conveying direction, the printer apparatus including: a paper conveying portion including a driving roller and a driven roller, the driving roller and driven roller being moveable with respect to one another between an engaged position at which the driving roller and the driven roller are pressed together and a disengaged position at which the driving roller and the driven roller are separated; wherein the paper conveying portion is situated downstream, with respect to the paper conveying direction, from the location at which the data is printed on the paper; and wherein the driving roller and the driven roller are operative to pressingly sandwich the paper therebetween when the driving roller and the driven roller are in the engaged position.

According to an embodiment of the present invention, the driving roller may include a roller part that has a plurality of fine protrusions disposed on a surface thereof, which fine protrusions protrude to dig into the paper when the paper is pressingly sandwiched between the driving roller and driven roller.

According to an embodiment of the present invention, the driving roller may include a roller part disposed at each end thereof.

According to an embodiment of the present invention, the driving roller may include a roller part disposed at the center thereof.

According to an embodiment of the present invention, the driving roller may include a roller part disposed over substantially the entire surface of the driving roller.

According to an embodiment of the present invention, the printer apparatus may further include a printing portion for printing the data on the paper, the printing portion being situated upstream of the paper conveying portion.

Furthermore, the present invention provides a printer apparatus for printing data on paper travelling through the printer apparatus in a paper conveying direction, the printer apparatus including: a thermal head; a platen roller; a paper conveying portion including a driving roller and a driven roller, the driving roller and driven roller being moveable with respect to one another between an engaged position at which the driving roller and the driven roller are pressed together and a disengaged position at which the driving roller and the driven roller are separated; wherein the thermal head and the platen roller are moveable relative to one another between an engaged position at which the thermal head and the platen roller are pressed together and a disengaged position at which the thermal head and the platen roller are separated; wherein the paper conveying portion is situated downstream, with respect to the paper conveying direction, from the thermal head; and wherein the driving roller and the driven roller are operative to pressingly sandwich the paper therebetween when the driving roller and the driven roller are in the engaged position.

According to an embodiment of the present invention, the platen roller may deliver a front-end of the paper by rotation thereof, wherein the driving roller and the driven roller may be disposed in the paper conveying portion so that the front-end of the paper, delivered from the thermal head by the rotation of the platen roller, is received between the driving roller and the driven roller, wherein the paper conveying portion may convey the delivered paper once the delivered paper is transferred to the paper conveying portion.

According to an embodiment of the present invention, the printer apparatus may further include: a motor; and a gear mechanism moved by the motor, the gear mechanism being coupled to the driving roller and the platen roller to rotate the driving roller and the platen roller in the same direction.

According to an embodiment of the present invention, the peripheral velocity of the driving roller may be faster than the peripheral velocity of the platen roller.

According to an embodiment of the present invention, the printer apparatus may further include: a one-way clutch for transmitting rotating motion of the gear mechanism to the platen roller, whereby the platen roller is rotated to thereby move the paper in the paper conveying direction.

According to an embodiment of the present invention, the printer apparatus may further include: a motor for rotating the driving roller; a gear disposed at an end of the driving roller; an oscillatory arm member disposed at an end of the driving roller, and including first and second arm parts pivoting in the same direction as the rotation of the driving roller; and first and second gears disposed on the respective first and second arm parts, which first and second gears engage said gear disposed at the end of the driving roller; wherein the oscillatory arm member rotates according to the rotation of the driving roller so that the gear of the arm portion engages with the gear disposed on the end of the driving roller.

According to an embodiment of the present invention, the driving roller and the platen roller may form a first module; the driven roller and the thermal head may form a second module; and the first module and second module may be detachably attached, whereby when attached the driving roller and the driven roller are pressed together and the platen roller and the thermal head are pressed together, and when detached the driving roller and the driven roller are separated and the platen roller and the thermal head are separated.

According to an embodiment of the present invention, the driven roller and the platen roller may form a first module; the driving roller and the thermal head may form a second module; and the first module and second module may be detachably attached, whereby when attached the driving roller and the driven roller are pressed together and the platen roller and the thermal head are pressed together, and when detached the driving roller and the driven roller are separated and the platen roller and the thermal head are separated.

Furthermore, the present invention provides a printer apparatus for printing data on paper travelling through the printer apparatus in a paper conveying direction, the printer apparatus including: a non-rotating platen pressing against a thermal head; an upstream paper conveying portion being situated upstream, with respect to the paper conveying direction, from the thermal head; a downstream paper conveying portion being situated downstream, with respect to the paper conveying direction, from the thermal head, the downstream paper conveying portion including a driving roller and a driven roller, the driving roller and driven roller being moveable with respect to one another between an engaged position at which the driving roller and the driven roller are pressed together and a disengaged position at which the driving roller and the driven roller are separated; wherein the driving roller and the driven roller are operative to pressingly sandwich the paper therebetween when the driving roller and the driven roller are in the engaged position.

It is another and more specific object of the present invention, for example, to provide a portable printer of a clamshell type that improves printing precision in a paper conveying direction without having to change the structure of a portion of a thermal head to which a rubber platen roller abuts.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

[First Embodiment]

Figure 1:
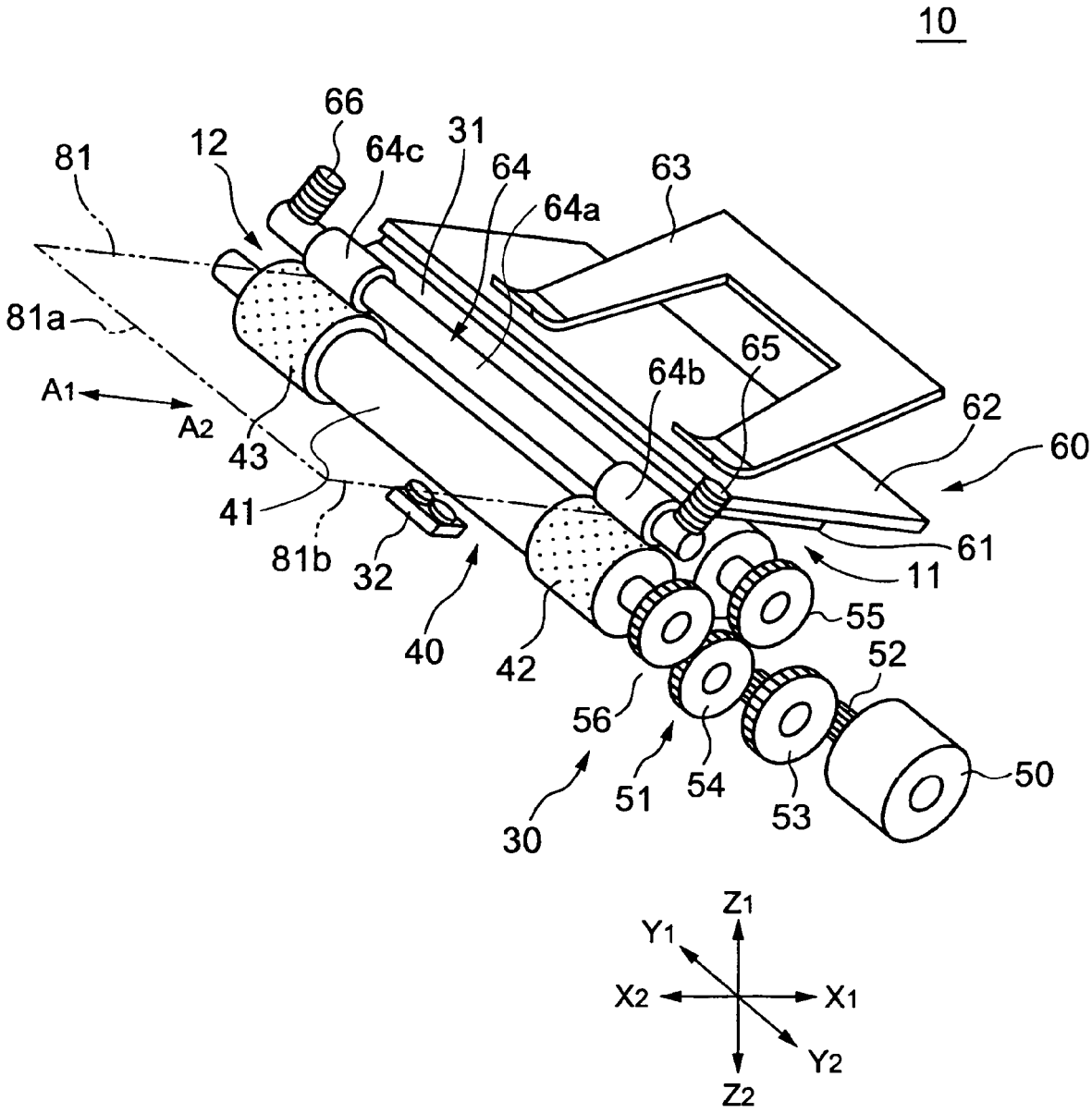
FIG. 1 is a perspective view showing an internal structure of a thermal printer according to a first embodiment of the present invention.
Figure 2:
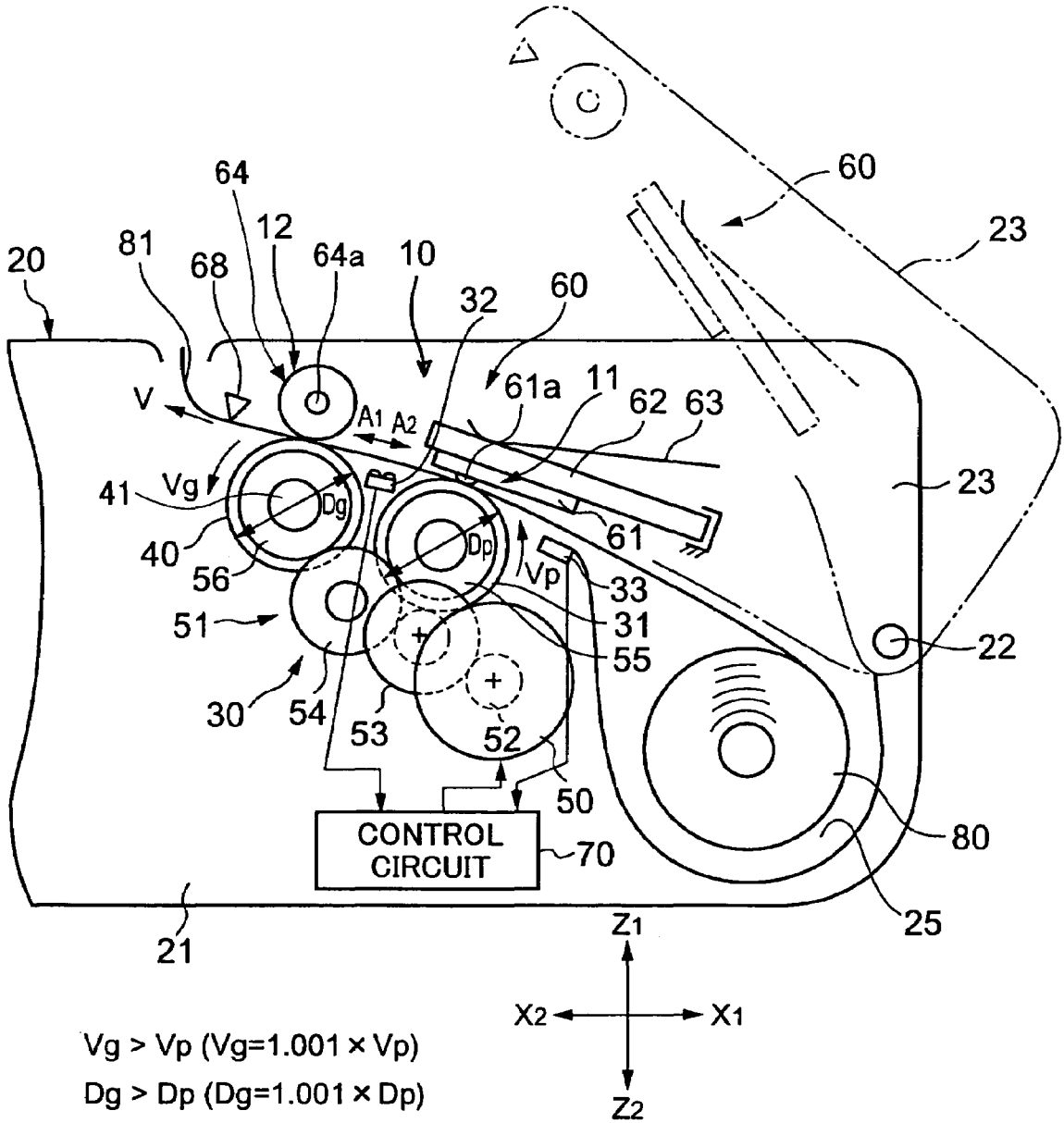
FIG. 2 is a front view showing a thermal printer according to a first embodiment of the present invention.

FIGS. 1 and 2 are drawings showing a thermal printer 10 according to a first embodiment of the present invention. The thermal printer 10 is a printer of a line printing type and is also of a clamshell type. X1-X2 indicates a longitudinal direction of the thermal printer 10, Y1-Y2 indicates a width direction of the thermal printer 10, and Z1-Z2 indicates a height direction of the thermal printer 10. A1 indicates a paper conveying direction, and A2 indicates a paper reversing direction.

The thermal printer 10 is assembled to a portable terminal apparatus 20. The portable terminal apparatus 20 includes a casing 21 and a cover 23 that is openably supported by an axial member 22 of the casing 21 at the X1 side. A paper roll installment portion 25 is disposed at the X1 side of the casing 21.

The thermal printer 10 has a main paper conveying portion 12 including a grip roller 40 serving as a driving roller and a pressing roller 64 serving as a driven roller. The main conveying portion 12 is situated more downstream in a paper conveying direction A1 than a sub-paper conveying portion 11 including a thermal head 61 and a platen roller 31, which is made of rubber in the illustrated exemplary embodiment.

Numeral 30 indicates a first module that is assembled inside the casing 21. Numeral 60 indicates a second module that is assembled inside the cover 23. When the cover 23 is open, the second module 60 is separated, that is detached, from the first module 30. When the cover 23 is closed and locked, the second module 60 is detachably attached to the first module 30.

The first module 30 includes the rubber-made platen roller 31, the grip roller 40, a pulse motor 50, a speed deceleration gear alignment 51, and first and second paper detecting sensors 32, 33, for example reflection type sensors, in which the components are supported by a frame (not shown). In an order of the second paper detection sensor 33, the platen roller 31, the first paper detecting sensor 32, and the grip roller 40, said components are aligned in direction A1.

Figure 3:
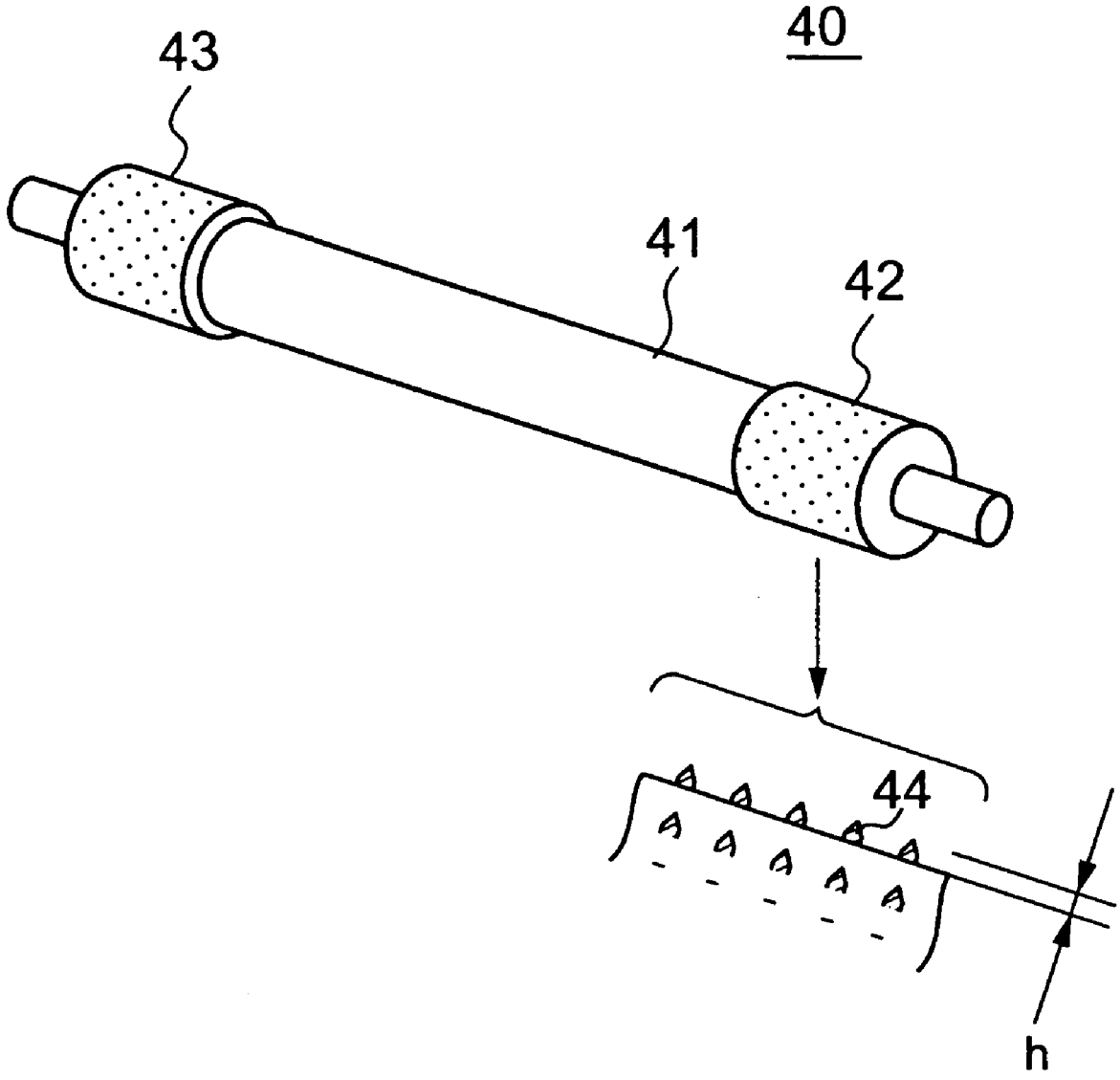
FIG. 3 is a diagram showing a grip roller according to an embodiment of the present invention.

The grip roller 40 is disposed more downstream in the paper conveying direction A1 than the platen roller 31. The grip roller 40 is made of metal material and is manufactured by rolling. As shown in FIG. 3, grip roller parts 42, 43 are disposed on both ends of a shaft 41 of the grip roller 40. The grip roller parts 42, 43 are situated at respective outer side portions of an area of a paper 81 on which printing is performed, that is, at a position corresponding to the rim portions on both sides of the paper 81. The grip roller parts 42, 43 have a diameter Dg wider than that of the shaft 41. As shown in FIG. 3, the grip roller parts 42, 43 have numerous fine protrusions 44 provided on a surface of the grip roller parts 42, 43. The fine protrusions 44 have sharp tips that form spikes. In an exemplary embodiment, the height h of the fine protrusions 44 is approximately 0.04 mm, and is smaller than the thickness t (FIG. 4) of the paper 81 on which printing is performed.

The speed deceleration gear alignment 51 includes a gear 52 situated on a shaft of the pulse motor 50, a double-step gear 53, a double-step gear 54, a gear 55 situated on an end of the platen roller 31, and a gear 56 situated on an end of the grip roller 40. The double-step gear 54 engages gears 55, 56.

The platen roller 31, the grip roller 40, the pulse motor 50, and the speed deceleration gear alignment 51 are arranged so that, when the pulse motor 50 is driven under a condition where the peripheral velocity Vg of the grip roller parts 42, 43 match with a paper conveying velocity V, the platen roller 31 rotates in the same direction as the grip roller 40, and the peripheral velocity Vg of the grip roller parts 42, 43 is slightly greater than a peripheral velocity Vp of the platen roller 31 (e.g. approximately 0.1% faster), that is, Vg>Vp. In order to satisfy the relation of Vg>Vp, the diameter Dg of the grip roller parts 42, 43 is slightly larger than a diameter Dp of the platen roller 31 (e.g. approximately 0.1% larger) (FIG. 2).

The pulse motor 50 and the first and second paper detecting sensors 32, 33 are electrically connected to a control circuit 70 which, in the exemplary embodiment, is a microcomputer.

The second module 60 includes a head supporting board member 62 having the thermal head 61 fixed thereto, a spring board member 63, the pressing roller 64, and a cutter blade 68, in which the components are supported by a frame (not shown).

The thermal head 61 has a heating part 61*a* arranged in direction Y1-Y2. The head supporting board member 62 is supported at its end portion on the X1 side. The spring board member 63 biases the thermal head 61 substantially towards direction Z2. The pressing roller 64 has pressing roller parts 64*b*, 64*c*, made of rubber in the illustrated exemplary embodiment, disposed on respective ends of a shaft 64*a* of the pressing roller 64. Spring members 65, 66 bias said both ends of the shaft 64*a* substantially towards direction Z2. In an order of the thermal head 61, the pressing roller 64, and the cutter blade 68, said components are aligned in the paper conveying direction A1.

It is to be noted that the platen roller 31, the grip roller 40, the thermal head 61, and the pressing roller 64 are arranged so that, when the second module 60 is attached to the first module 30, the heating part 61*a* of the thermal head 60 abuts the platen roller 31, and the pressing roller parts 64*b*, 64*c* abut the respective grip roller parts 42, 43.

The paper 81 is fed by the sub-paper conveying portion 11 in a case where the paper 81 is not held by the main paper conveying portion 12, and is fed by the main paper conveying portion 12 in a case where the paper 81 is held by the main paper conveying portion 12. In the main paper conveying portion 12, the fine protrusions 44 of the grip roller parts 42, 43 dig into the bottom surface of the paper 81, to thereby provide a conveying force to the paper 81. Accordingly, paper can be conveyed with high precision, printing upon the conveyed paper can be performed with excellent precision, and the paper can be conveyed without encountering any slippage.

Next, an exemplary operation of the thermal printer 10 is described.

Figures 5A, 5B, 5C, 5D, 5E, 5F, 5G, 5H:
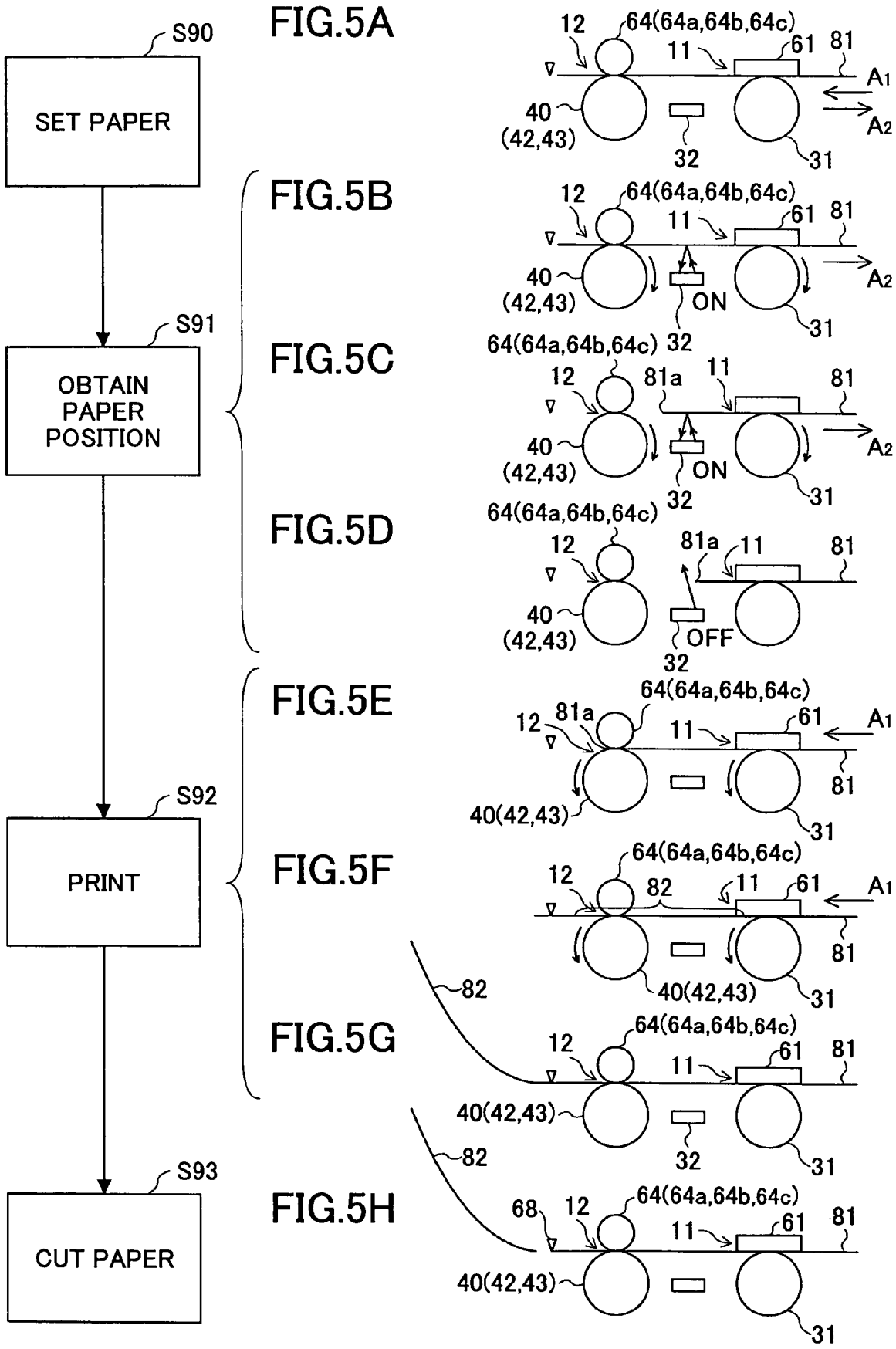
FIGS. 5A through 5H are views for explaining an operation of a thermal printer according to an embodiment of the present invention.

Referring to FIGS. 5A through 5H, and initially to FIG. 5A, first, the paper 81 is set (Step S90). Here, the operator opens the cover 23, installs a thermal paper roll 80 into the paper roll installment portion 25, pulls out the paper 81, and then closes the cover 23. Thereby, as shown in FIG. 5B, the paper 81 is sandwiched at the sub-paper conveying portion 11 between the thermal head 61 (via the heating part 61*a* of the thermal head 61) and the platen roller 31, which presses against the thermal head 61, and at the main paper conveying portion 12 (situated downstream of the sub-paper conveying portion 11 with respect to the paper conveying direction A1) between the pressing roller 64 (via the pressing roller parts 64*b*, 64*c* of the pressing roller 64) and the grip roller 40, which presses against the pressing roller 64.

The main paper conveying portion 12 is disposed in a manner allowing a front-end part 81*a* of the paper 81 to be received at the abutting portion between the grip roller 40 and the pressing roller 64.

After the paper 81 is detected by the first paper detecting sensor 32 in a state where the cover 23 is closed, for example, the thermal printer 10 is further controlled and operated according to the control circuit 70.

Then, in step S91, a paper position is obtained in response to a printing command. First, as shown in FIG. 5B, the pulse motor 50 (FIGS. 1 and 2) is reversely driven, and the platen roller 31 and the grip roller 40 are rotated in a clockwise direction, to thereby reversely move the paper 81 toward direction A2.

As shown in FIGS. 5C and 5D, the paper 81 is reversely moved such that the front-end part 81*a* deviates from the grip roller parts 42, 43. The paper 81 is reversely moved until the first paper detecting sensor 32 detects the front-end part 81*a* and is switched to an OFF state. As a result, the position of the front-end part 81*a* of the paper 81 is obtained, and the procedure of obtaining the paper position is completed.

Next, a printing procedure is started (Step S92). The pulse motor 50 is forwardly driven, and the platen roller 31 and the grip roller 40 are rotated in a counterclockwise direction, to thereby move the paper 81 toward direction A1. After the first paper detecting sensor 32 is switched to an ON state, the thermal head 61 is activated, to thereby start printing upon the paper 81.

After the front-end part 81*a* of the paper 81 is inserted between the grip roller parts 42, 43 and the respective pressing roller parts 64*b*, 64*c* (as shown in FIG. 5E), the grip roller parts 42, 43 and the pressing roller parts 64*b*, 64*c*, together with the platen roller 31, convey the paper 81 toward direction A1. Accordingly, the paper 81 is smoothly transferred from the sub-paper conveying portion 11 to the main paper conveying portion 12, and is conveyed further on by the main paper conveying portion 12. Numeral 82 indicates an area on which printing is performed, for example.

Here, the paper 81 is in a state abutting the rubber-made platen roller 31 at the sub-paper conveying portion 11 while the fine protrusions 44 are dug into the bottom surface of the paper 81 at the main paper conveying portion 12. Accordingly, the conveying force applied to the paper 81 at the main paper conveying portion 12 is greater compared to that at the sub-paper conveying portion 11. The main paper conveying portion 12, therefore, conveys the paper 81 at a prescribed speed corresponding to the peripheral velocity Vg of the grip roller parts 42, 43. Since the fine protrusions 44 of the grip roller parts 42, 43 are dug into the bottom surface of the paper 81, no slippage will occur between the paper 81 and the grip roller parts 42, 43. Accordingly, the paper 81 can be conveyed with high precision. As a result, printing can be performed with higher precision. It is to be noted that, owing to the relation of Vg>Vp, a slight slippage of the paper 81 may occur at the platen roller 31.

By the time when the paper 81 is fed out from the sub-paper conveying portion 11, the grip roller 40 will be rotating and the main paper conveying portion 12 will be in a state ready to convey the paper 81. Therefore, the transition of conveying the paper 81 at the sub-paper conveying portion 11 to conveying the paper 81 at the main paper conveying portion 12 can be conducted smoothly.

After a command to end the printing procedure, the pulse motor 50 comes to a stop after performing step movements of a prescribed count. The portion of the paper 81 at which printing ends is situated slightly beyond the cutter blade 68 toward direction A1. This state is illustrated in FIG. 5G.

Then, a procedure of cutting the printed part 82 of the paper 81 is executed in step S93. The operator pulls out the printed part 82, which is fed out from the portable terminal apparatus, and the cutter blade 68 cuts the printed part 82 as shown in FIG. 5H.

When another printing command is transmitted, the above-described operation is performed likewise.

Figure 4:
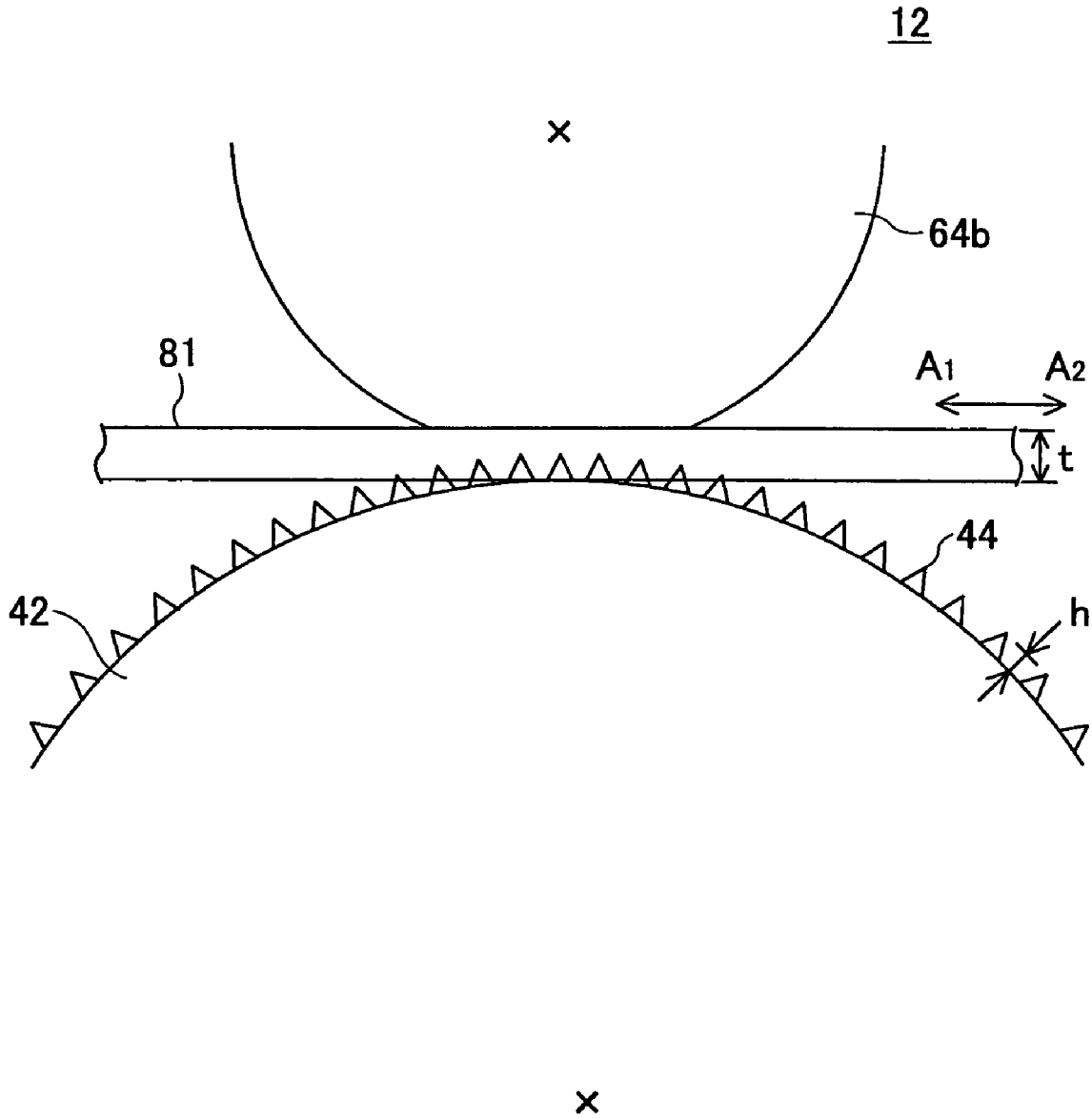
FIG. 4 is an enlarged view showing a main paper conveying portion according to an embodiment of the present invention.

As described above, the grip roller parts 42, 43 are made of metal material, and therefore, have a greater dimensional accuracy and wear-resistance compared to a rubber-made roller. Since the fine protrusions 44 of the grip roller parts 42, 43 dig into the bottom surface of the paper 81, as shown in FIG. 4, no slippage occurs between the paper 81 and the grip roller parts 42, 43 regardless of factors such as temperature and/or humidity. This allows the thermal printer 10 to maintain a highly precise paper conveying velocity for a long period. As a result, a high printing precision in the paper conveying direction can be maintained for a long period. This allows the thermal printer to satisfactorily print out, for example, barcodes and meter readouts.

Figure 6:
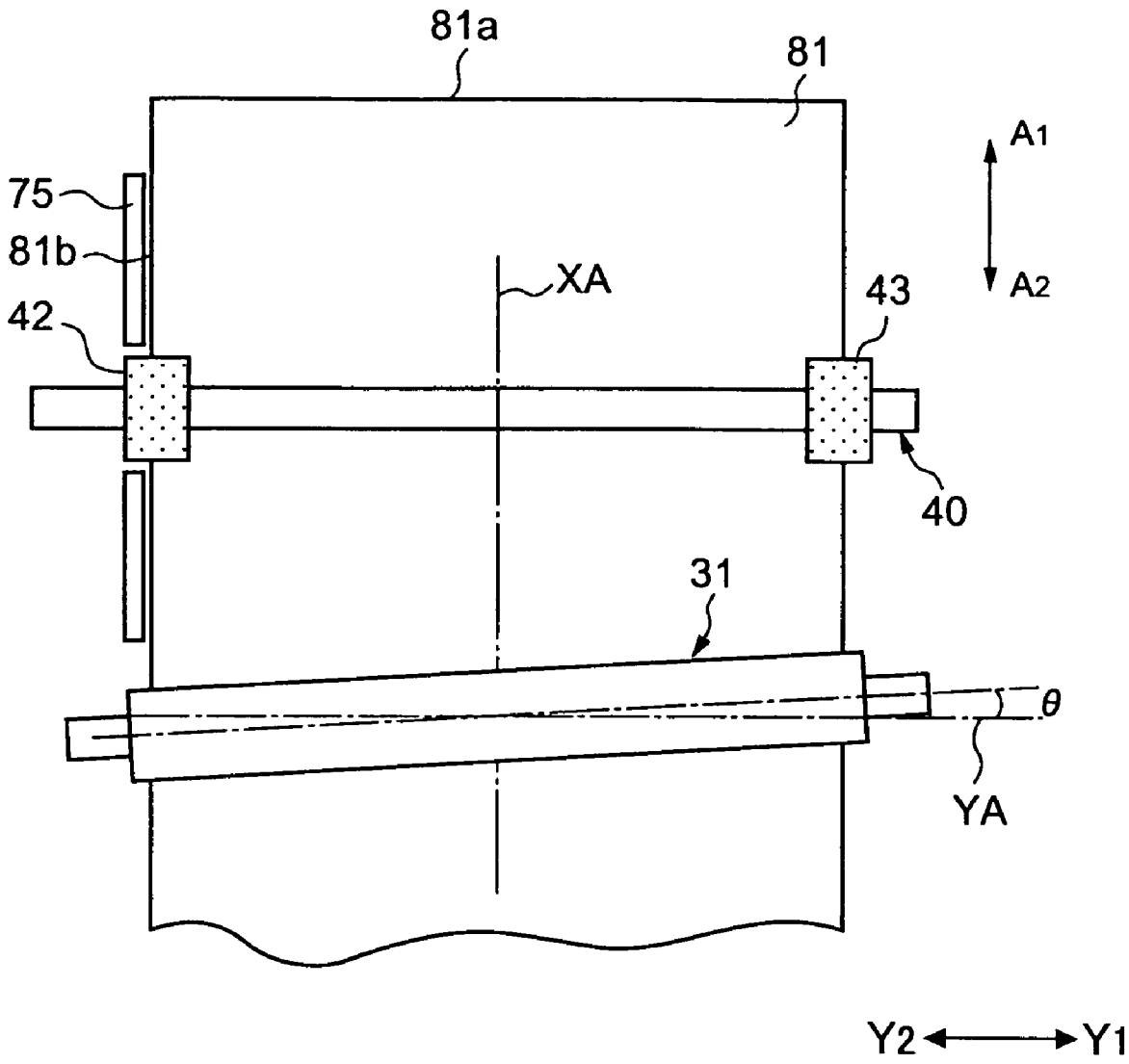
FIG. 6 is a diagram showing a slant prevention conveying mechanism according to an embodiment of the present invention.

FIG. 6 shows the platen roller 31 disposed in a manner slightly tilting in an angle θ with respect to line YA that perpendicularly intersects with center line XA of a paper conveying path, and a paper guide member 75 disposed on a side toward Y2.

The tilting of the platen roller 31 causes the conveyed paper 81 to be drawn toward the side of Y2, and the paper guide member 75 guides a rim part 81*b* (on the side of Y2) of the conveyed paper 81 to prevent the conveyed paper 81 from being slantingly conveyed.

The control circuit 70 controls the operation of the thermal printer 10 differently according to the type of paper being used.

Figure 7A:
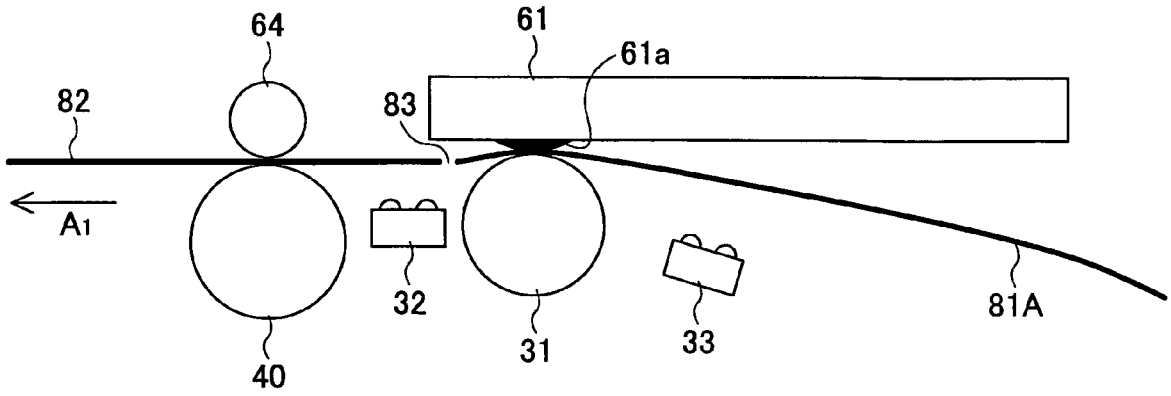
FIGS. 7A and 7B are diagrams for explaining procedures of printing and conveying an uncut type paper provided with a perforation.
Figure 7B:
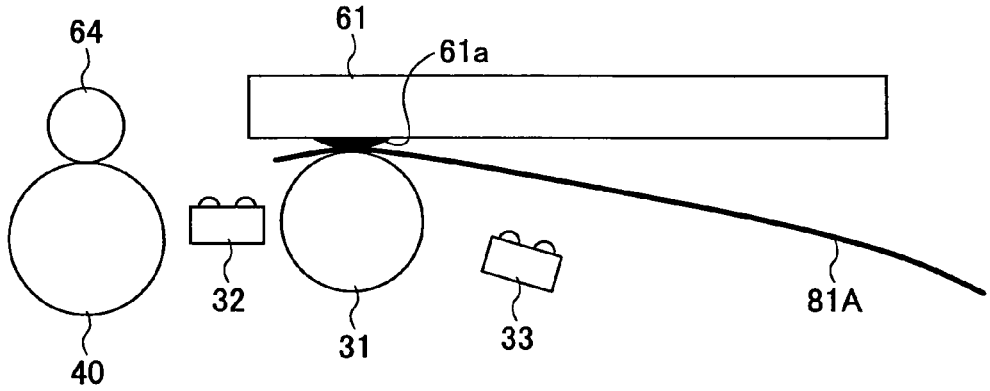

In a case of using an uncut type of paper 81A provided with a perforation 83, the pulse motor 50 reversely moves for a prescribed number of steps, and consequently the platen roller 31 moves clockwise, from a state shown in FIG. 5G, and then comes to a stop in a manner shown in FIG. 7A.

In the reverse movement of the pulse motor 50, and the consequent clockwise movement of the platen roller 31, the uncut type of paper 81A is conveyed in direction A2. When the reverse movement of the pulse motor 50 comes to a stop, the perforation 83 of the uncut type paper 81A is positioned between the grip roller 40 and the platen roller 31, and a portion of the printed part 82 situated proximal to the edge of the printed part 82 on the side of A2 is clamped and supported by the grip roller 40 and the pressing roller 64.

The printed part 82 is then pulled, for example, by the operator, in direction A1 to separate (cut) the uncut type paper 81A along the perforation 83, and draw out the printed part 82 from the clamped position. Then, another printing procedure may be started after the paper position is obtained by the first paper detecting sensor 32.

Figure 8A:
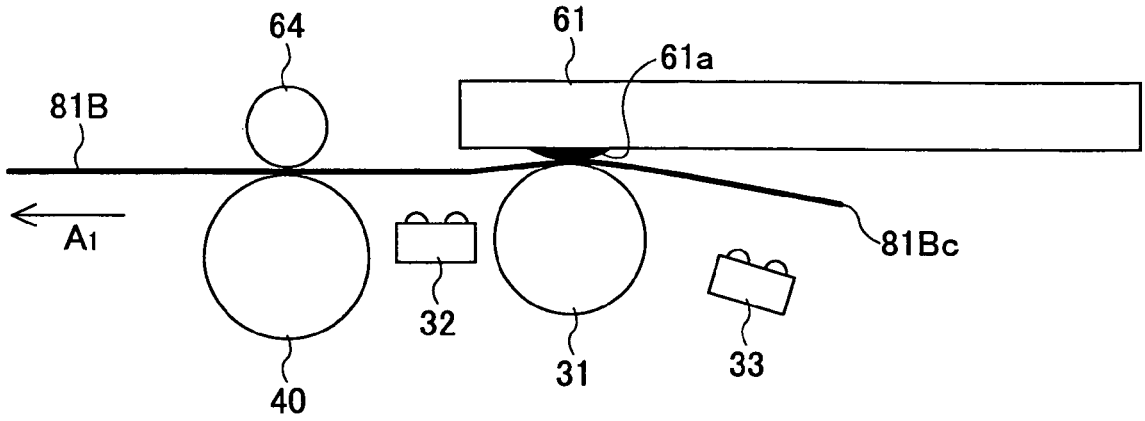
FIGS. 8A and 8B are diagrams for explaining procedures of printing and conveying a cut type paper.
Figure 8B:
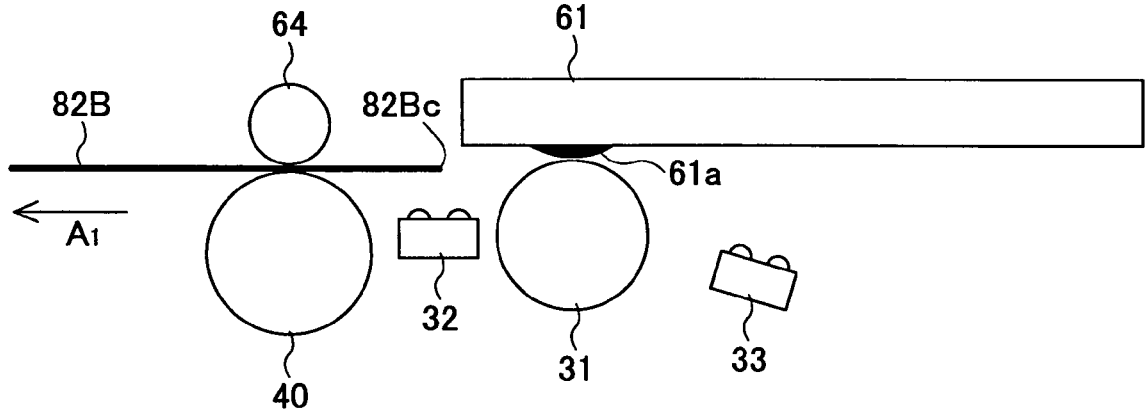

In a case of using a cut type of paper 81B (FIGS. 8A and 8B), a printing operation is commenced when the second paper detecting sensor 33 detects a rear-end part 81Bc of the cut type paper 81B. After performing a prescribed amount of printing, the printing operation is completed. This operation is shown in FIG. 8A. When printing of the cut type paper 81B is completed, a portion of the printed part 82 (FIG. 8B) situated proximal to the edge of the printed part 82 on the side of A2 is clamped and supported by the grip roller 40 and the pressing roller 64.

The printed part 82 is then pulled, for example, by the operator, in direction A1 to draw out the printed part 82 from the clamped position.

Next, exemplary variations of the thermal printer 10 are described.

Figure 9:
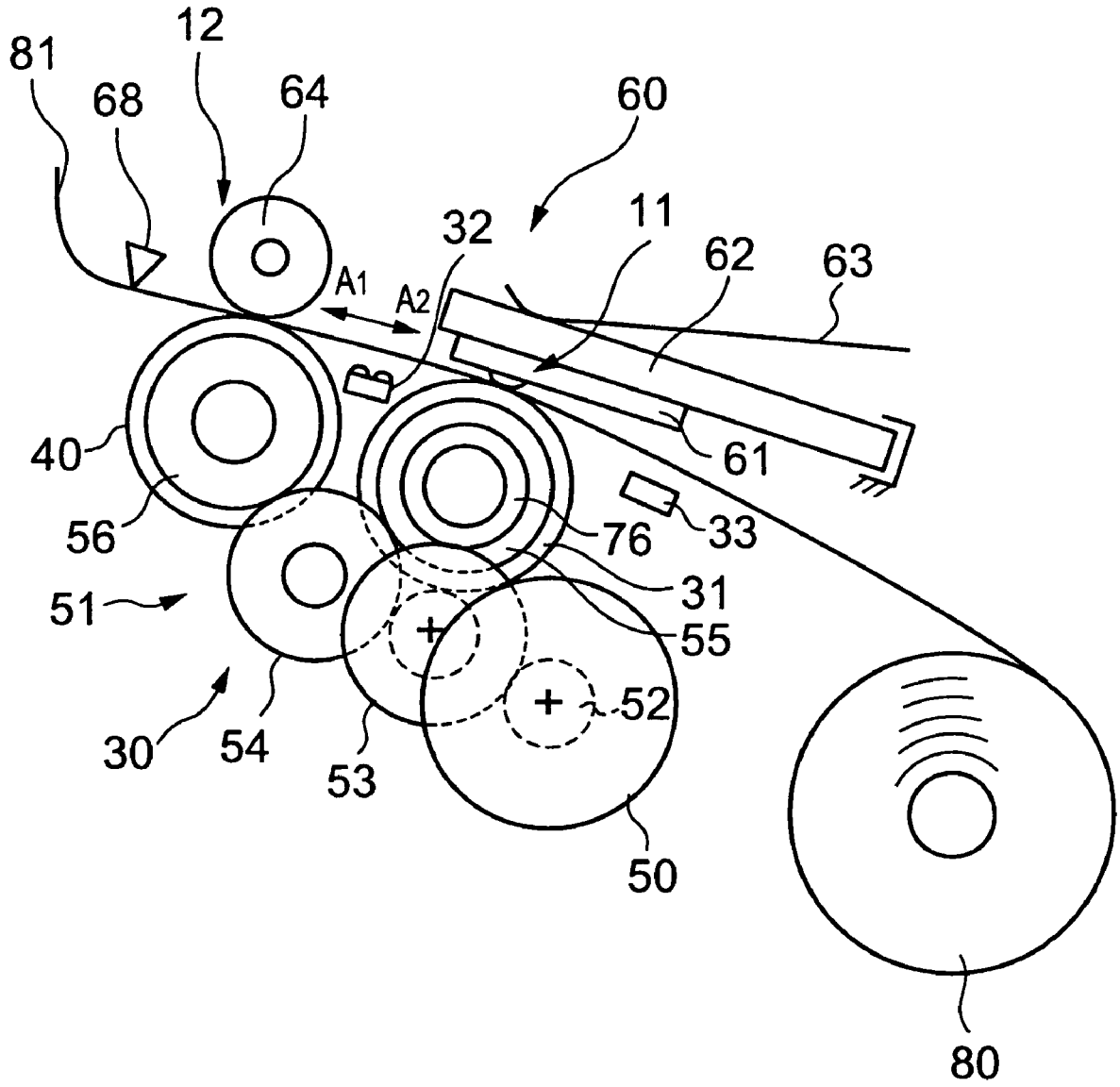
FIG. 9 is a diagram showing a first variation of the thermal printer shown in FIG. 1.

FIG. 9 shows a first variation of the thermal printer 10, in which a one-way clutch 76 is assembled to a gear 55 disposed on an end of the platen roller 31. The one-way clutch 76 operates so that the counterclockwise rotation of the gear 55 is transmitted to the platen roller 31. From an aspect where the platen roller 31 serves as a driving part, the one-way clutch 76 operates so that the counter clockwise rotation of the platen roller 31 is not transmitted to the gear 55.

The platen roller 31, being rotated counterclockwise by the one-way clutch 76, delivers an end part of the paper 81 in direction A1 from the sub-paper conveying portion 11. When the end part of the paper 81 is received between the grip roller 40 and the pressing roller 64 of the main paper conveying portion 12, the paper 81 is then conveyed in the main paper conveying portion 12 at a rate faster than the sub-paper conveying portion 11. Accordingly, the platen roller 31, now being tangentially pulled by the paper 81, is rotated at a faster rate, whereby the speed of rotation of the platen roller 31 exceeds that which is provided by the gear 55 that is rotated by the motor 50. This creates a state where the one-way clutch 76 no longer transmits rotation from the gear 55 to the platen roller 31, and where the platen roller 31 is thus rotated independently from the gear 55, and thus in accordance with the movement of the conveyed paper 81. As a result, no slippage occurs between the platen roller 31 and the paper 81. Therefore, the braking force that works on the paper 81 conveyed in direction A1 can be reduced and conveyance precision of the paper 81 can be improved.

Furthermore, as the period for using a printer becomes longer, the platen roller 31 wears away and the diameter thereof becomes smaller. This causes the rotation speed of the platen roller 31 rotating in accordance with the movement of the conveyed paper 81 to increase, and the speed difference between the rotation of the platen roller 31 and the rotation of the gear 55 (rotated by the motor 50) to become larger. In this situation, the one-way clutch 76 transmits no rotation from the gear 55 to the platen roller 31 and maintains a state of not transmitting the rotation, and the platen roller 31 is thus rotated independently from the gear 55.

Figure 10:
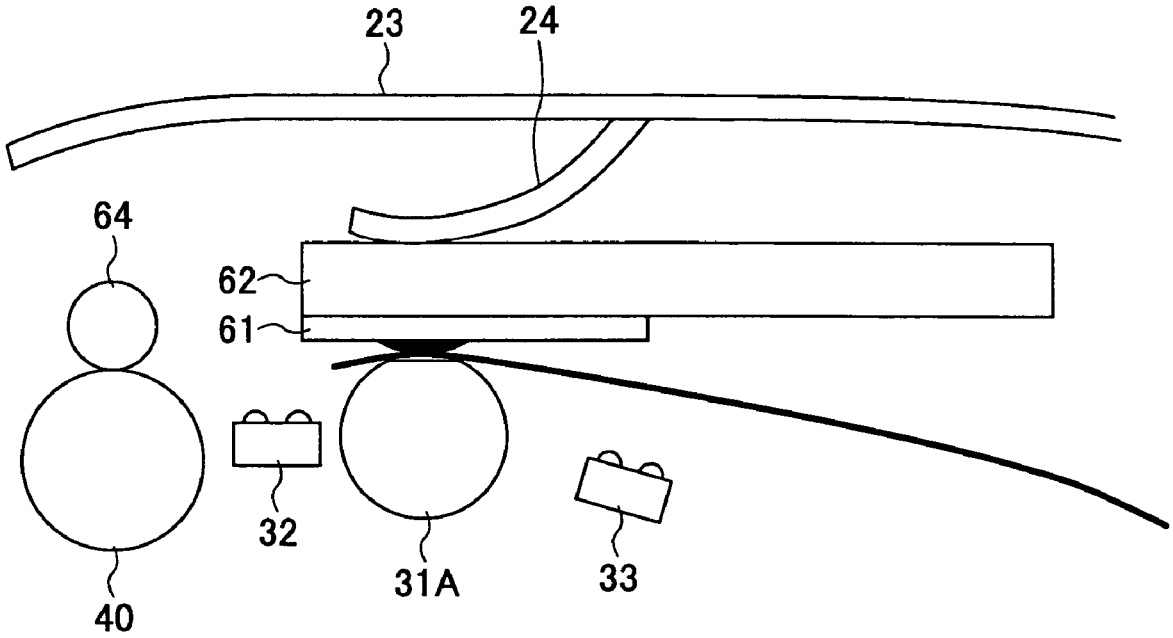
FIG. 10 is a diagram showing a second variation of the thermal printer shown in FIG. 1.

FIG. 10 shows a second variation of the thermal printer 10, in which a platen roller 31A is formed of a rubber material having a relatively lower degree of hardness than, for example, the platen roller 31. In this variation, a pressing force of the thermal head 61, which is less than, for example, that which was previously described, will suffice since the platen roller 31A is formed of a rubber material having a relatively lower degree of hardness. Accordingly, a board spring portion 24 is formed at a portion of the cover 23 that is made from synthetic resin for biasing the thermal head 61. In this case, a spring board member, which is a separate component, is not required.

[Second Embodiment]

Figure 11:
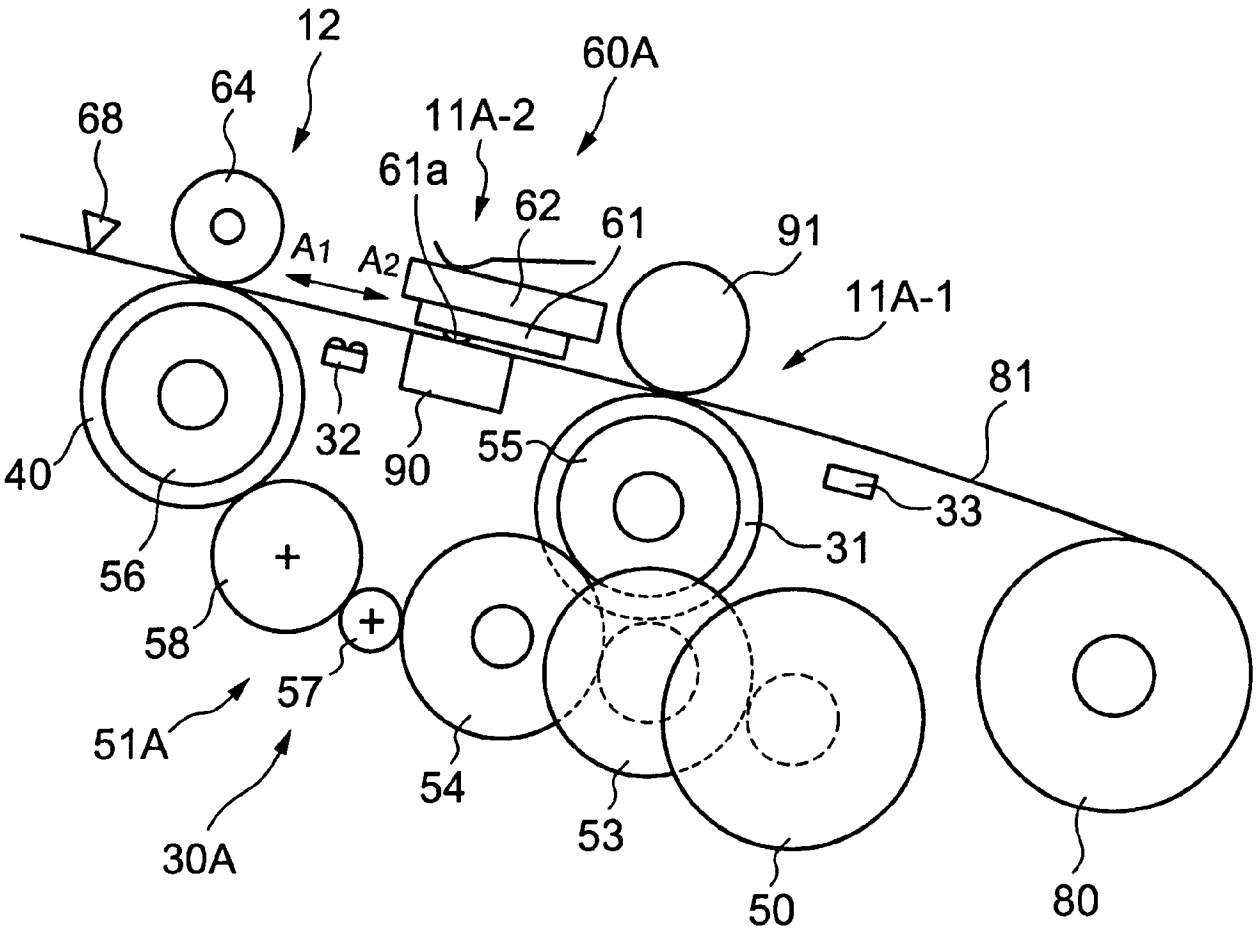
FIG. 11 is a schematic view showing a thermal printer according to a second embodiment of the present invention.

FIG. 11 is a schematic diagram showing a thermal printer 10A according to a second embodiment of the present invention. The thermal printer 10A has a structure where the sub-paper conveying portion 11 shown in FIG. 2 is separated into a sub-paper conveying part 11A-1 and a printing part 11A-2.

In an order of the sub-paper conveying part 11A-1, the printing part 11A-2, and the main paper conveying portion 12, said components are aligned in direction A1.

A first module 30A includes the platen roller 31, the grip roller 40, the pulse motor 50, and a speed deceleration gear alignment 51A, and the first and second paper (for example, reflection type) detecting sensors 32, 33, in which the components are supported by a frame (not shown). In an order of the second paper detecting sensor 33, the platen roller 31, a flat-shaped platen 90, the first paper detecting sensor 32, the grip roller 40, said components are aligned in direction A1. The speed deceleration gear alignment 51A has a structure where the speed deceleration gear alignment 51 shown in FIG. 2 is added with gears 57 and 58.

A second module 60A includes the head supporting board member 62 having the thermal head 61 fixed thereto, the spring board member 63, the pressing roller 64, and the cutter blade 68, and a pressing roller 91, in which the components are supported by a frame (not shown).

The sub-paper conveying part 11A-1 is formed of the platen roller 31 and the pressing roller 91. The printing part 11A-2 is formed of the thermal head 61 and the flat-shaped platen 90.

Since the platen 90 has a flat shape, a strict precision in the position between the thermal head 60 and the platen 90 is not required.

The sub-paper conveying part 11A-1 and the main paper conveying part 12 operate in the same manner as described with the thermal printer 10.

[Third Embodiment]

FIG. 12 is a schematic diagram showing a thermal printer 10B according to a third embodiment of the present invention. The thermal printer 10B has a structure where the speed deceleration gear alignment 51 shown in FIG. 1 is replaced by an oscillating gear mechanism 100.

The oscillatory gear mechanism 100 includes a gear 101 fixed to a shaft of the grip roller 40, a V-shaped oscillatory arm member 102 (shaded gray) with the shaft of the grip roller 40 serving as its center for oscillation, and gears 103, 104 engaged with the gear 101, and supported by respective arm parts 102*a*, 102*b* of the oscillatory arm member 102. The arm member 102 and the grip roller 40 have a sliding clutch (not shown) disposed therebetween. By the rotation of the grip roller 40, the oscillatory arm member 102 is rotated via the frictional force of the sliding clutch until the gears are engaged in a direction same as the rotating direction of the grip roller 40.

The pulse motor 50B rotates the grip roller 40 via a speed deceleration gear alignment 51B.

Figure 12A:
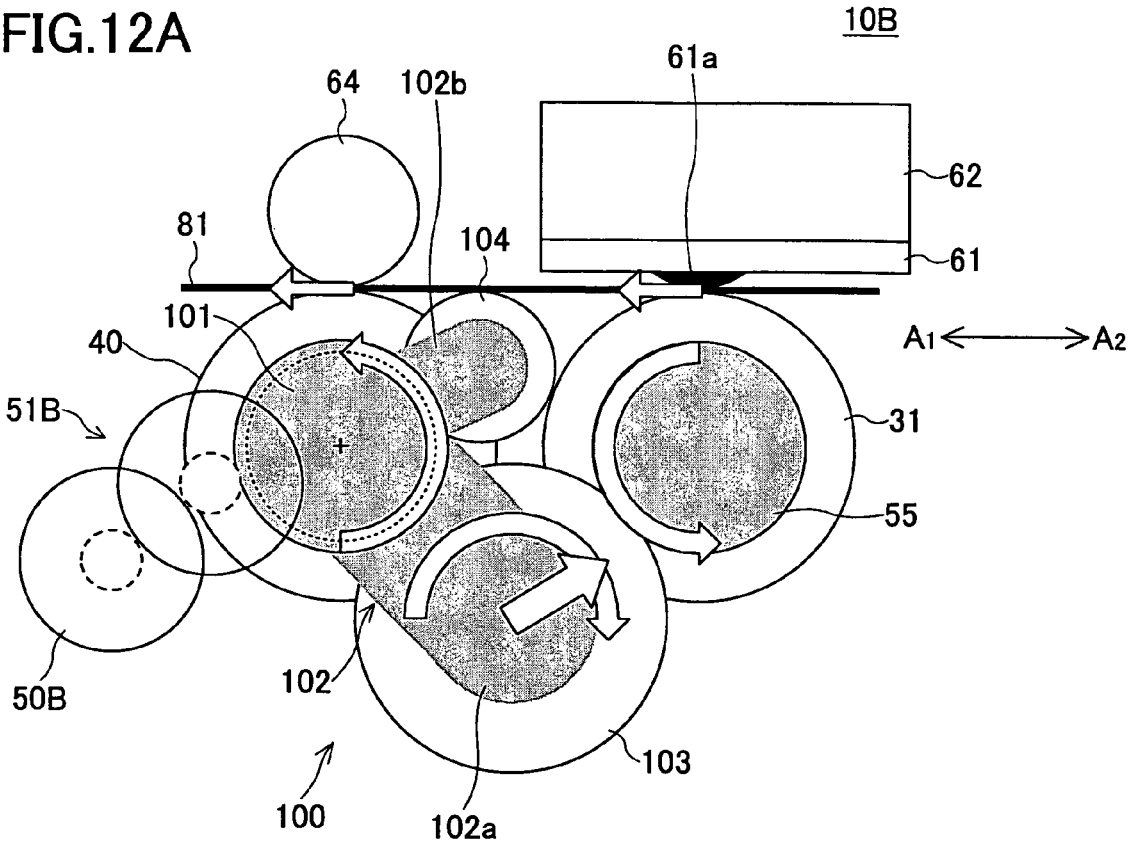
FIGS. 12A and 12B are schematic views showing a thermal printer according to a third embodiment of the present invention.

As shown in FIG. 12A, when the pulse motor 50B is forwardly (i.e. counterclockwise) rotated, the grip roller 40 is rotated in a counterclockwise direction via the speed deceleration gear alignment 51B. The oscillatory arm member 102 is also rotated in a counterclockwise direction. Then, the gear 103, urged by the oscillatory arm member 102, engages with the gear 55 situated on an end of the platen roller 31 to rotate the platen roller 31 in a counterclockwise direction.

Figure 12B:
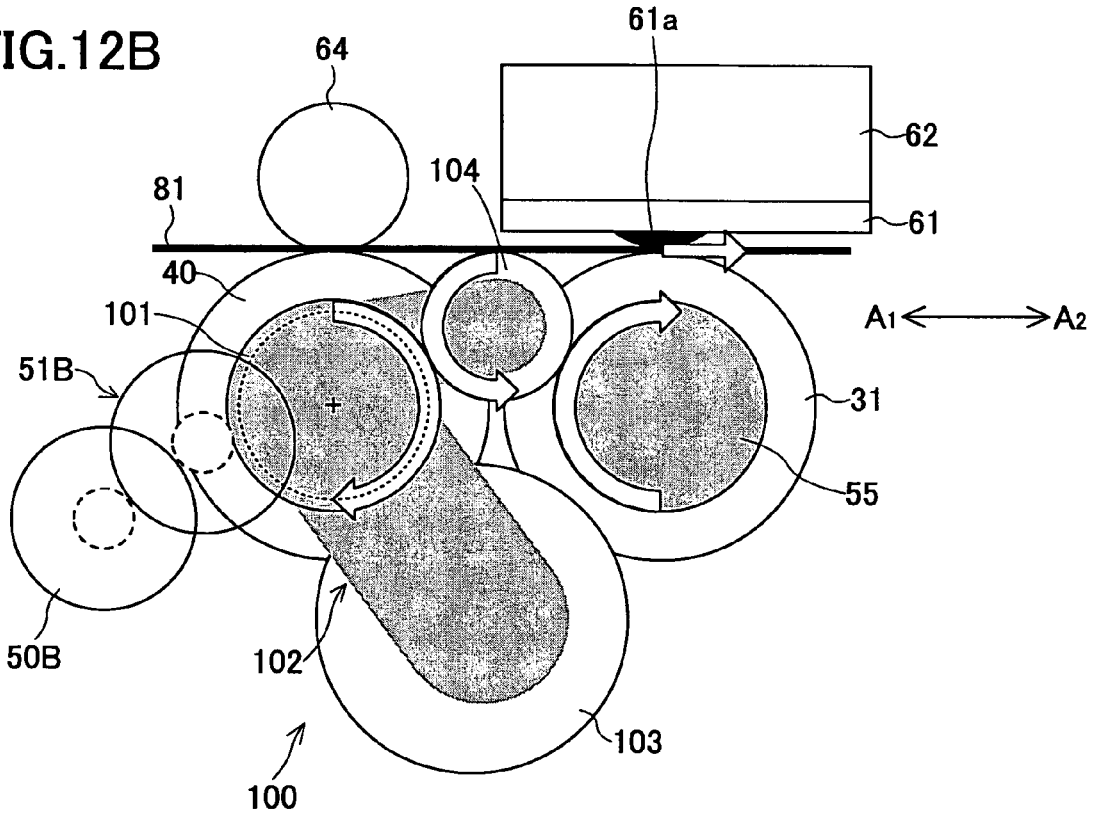

As shown in FIG. 12B, when the pulse motor 50 is reversely rotated (i.e. clockwise) the grip roller 40 is rotated in a clockwise direction via the speed deceleration gear alignment 51B. The oscillatory arm member 102 is also rotated in a clockwise direction. Then, the gear 104, urged by the oscillatory arm member 102, engages with the gear 55 to rotate the platen roller 31 in a clockwise direction.

[Fourth Embodiment]

The thermal printer described in the fourth through ninth embodiments below is provided in a manner such that the length L between the position at which the heating part 61*a* of the thermal head 61 presses against the paper 81 and the position at which the paper 81 is sandwiched by the grip roller 40 and the pressing roller 64 is short.

Figure 13:
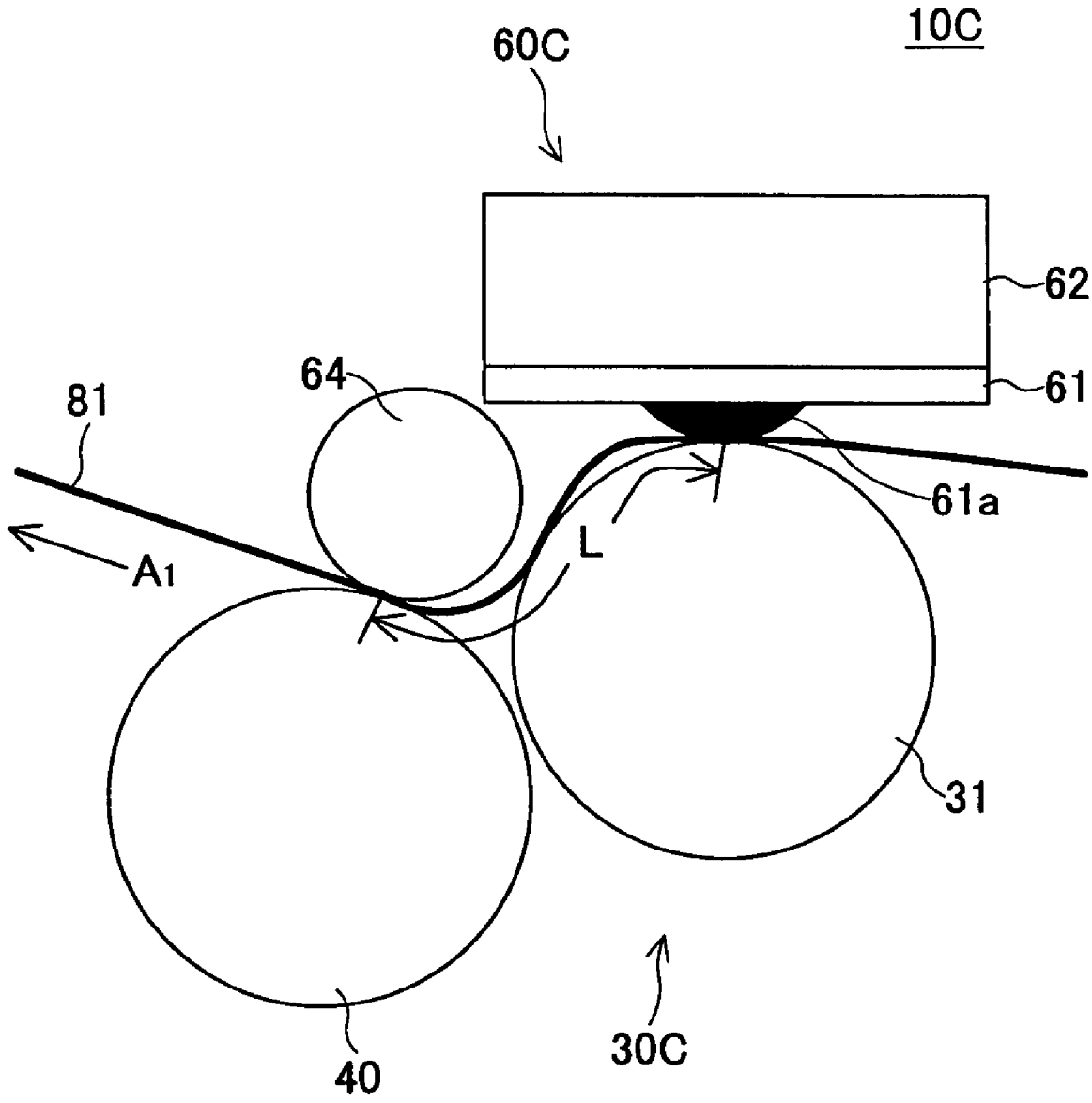
FIG. 13 is a schematic view showing a thermal printer according to a fourth embodiment of the present invention.

FIG. 13 is a schematic diagram showing a thermal printer 10C according to the fourth embodiment of the present invention. A first module 30C includes the platen roller 31 and the grip roller 40. A second module 60C includes the thermal head 61, the head supporting board member 62, and the pressing roller 64.

The grip roller 40 is disposed lower than and proximal to the platen roller 31 such that the grip roller 40 and the platen roller 31 are situated at a different level. The pressing roller 64, abutting the grip roller 40, is disposed lower than the thermal head 61 and distal to the platen roller 31. Accordingly, the length L is short.

[Fifth Embodiment]

Figure 14:
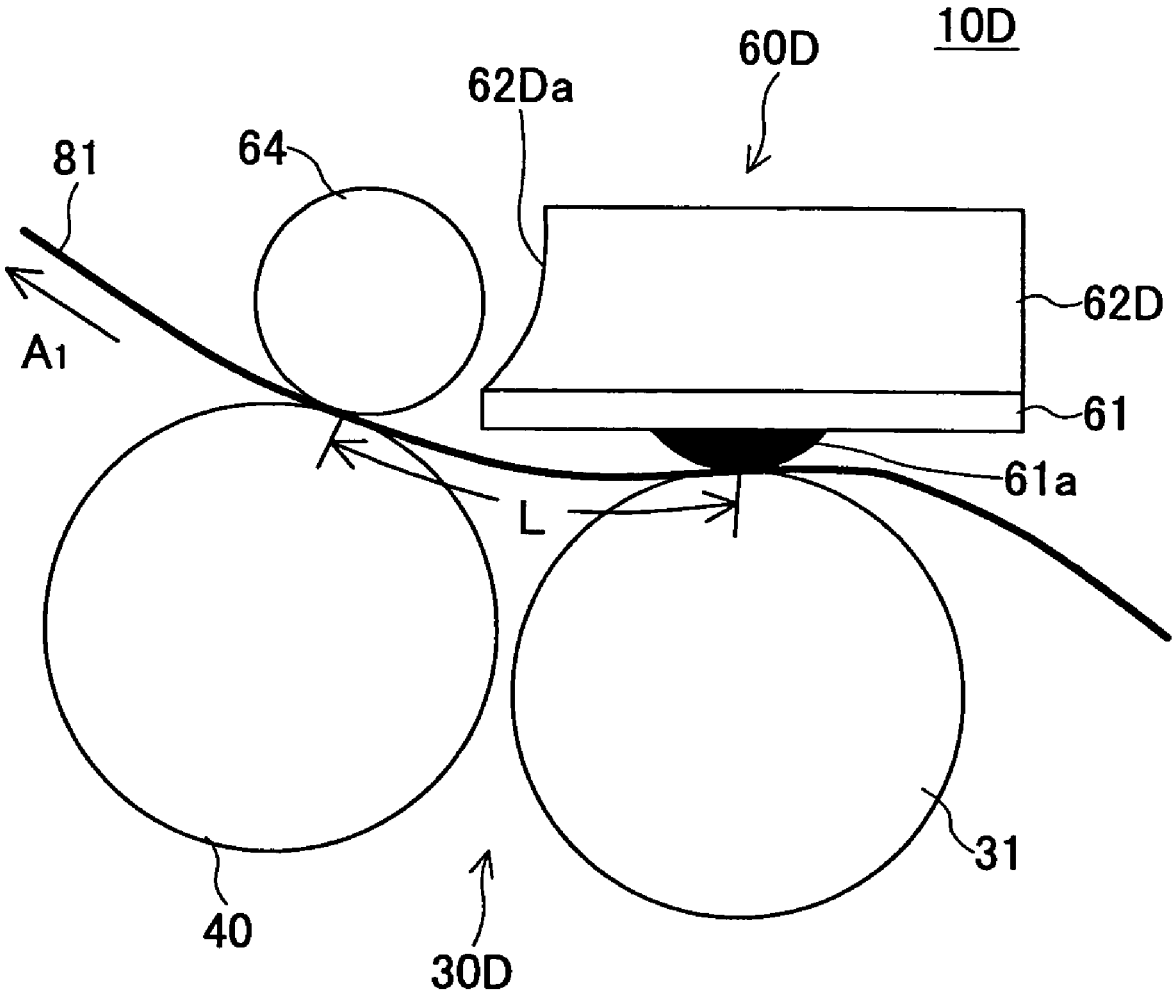
FIG. 14 is a schematic view showing a thermal printer according to a fifth embodiment of the present invention.

FIG. 14 is a schematic diagram showing a thermal printer 10D according to the fifth embodiment of the present invention. A first module 30D includes the platen roller 31 and the grip roller 40. A second module 60D includes the thermal head 61, a head supporting board member 62D, and the pressing roller 64.

The head supporting board member 62D has a notch part 62Da formed on an upper surface of an end part thereof (toward the side of A1). A portion of the pressing roller 64 is fitted into the notch part 62Da, and is disposed proximal to the platen roller 31. The grip roller 40 is disposed in a position abutting the pressing roller 64. Accordingly, the length L is short.

[Sixth Embodiment]

Figure 15:
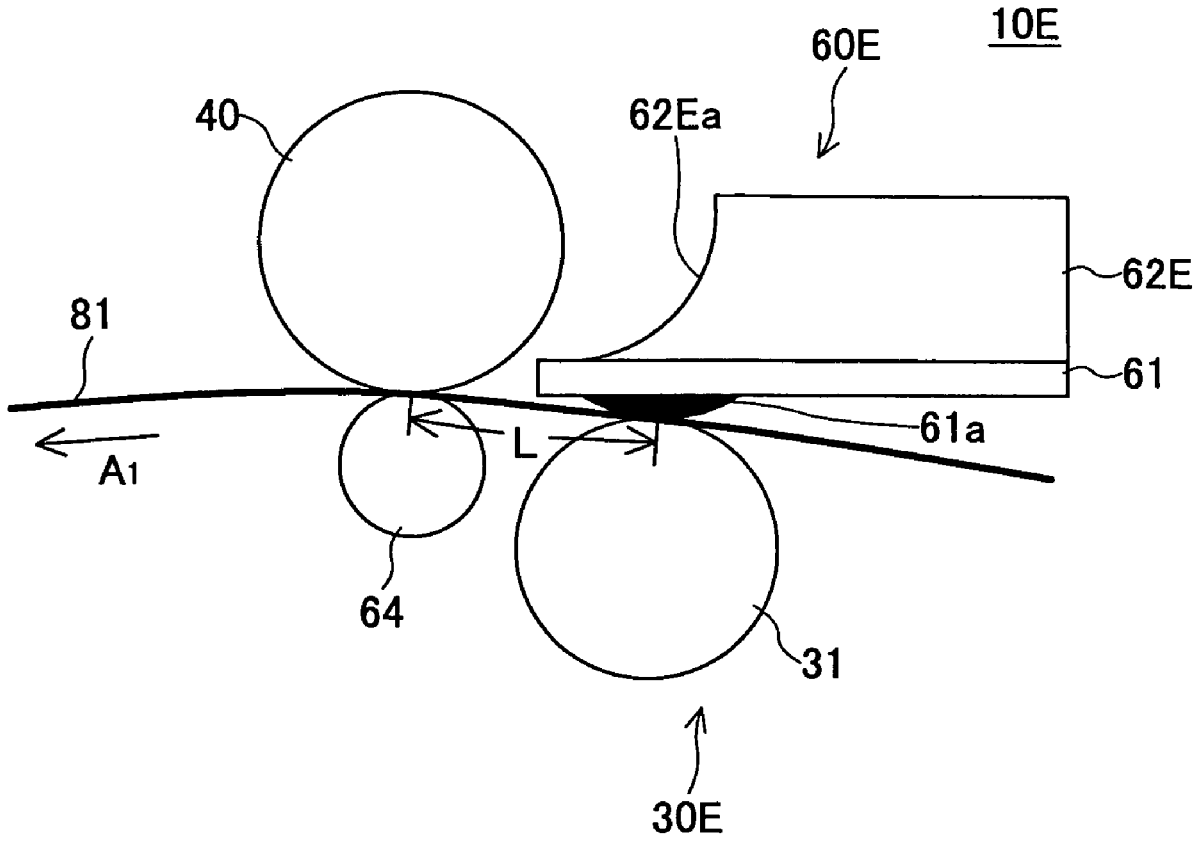
FIG. 15 is a schematic view showing a thermal printer according to a sixth embodiment of the present invention.

FIG. 15 is a schematic diagram showing a thermal printer 10E according to the sixth embodiment of the present invention. The thermal printer 10E has a structure where the positions of the pressing roller 64 and the grip roller 40 described in the thermal printer 10D are switched. A first module 30E includes the platen roller 31 and the pressing roller 64. A second module 60E includes the thermal head 61, a head supporting board member 62E, and the grip roller 40.

A portion of the pressing roller 40 is fitted into the notch part 62Ea, and is disposed proximal to the platen roller 31. Accordingly, the length L is short.

[Seventh Embodiment]

Figure 16A:
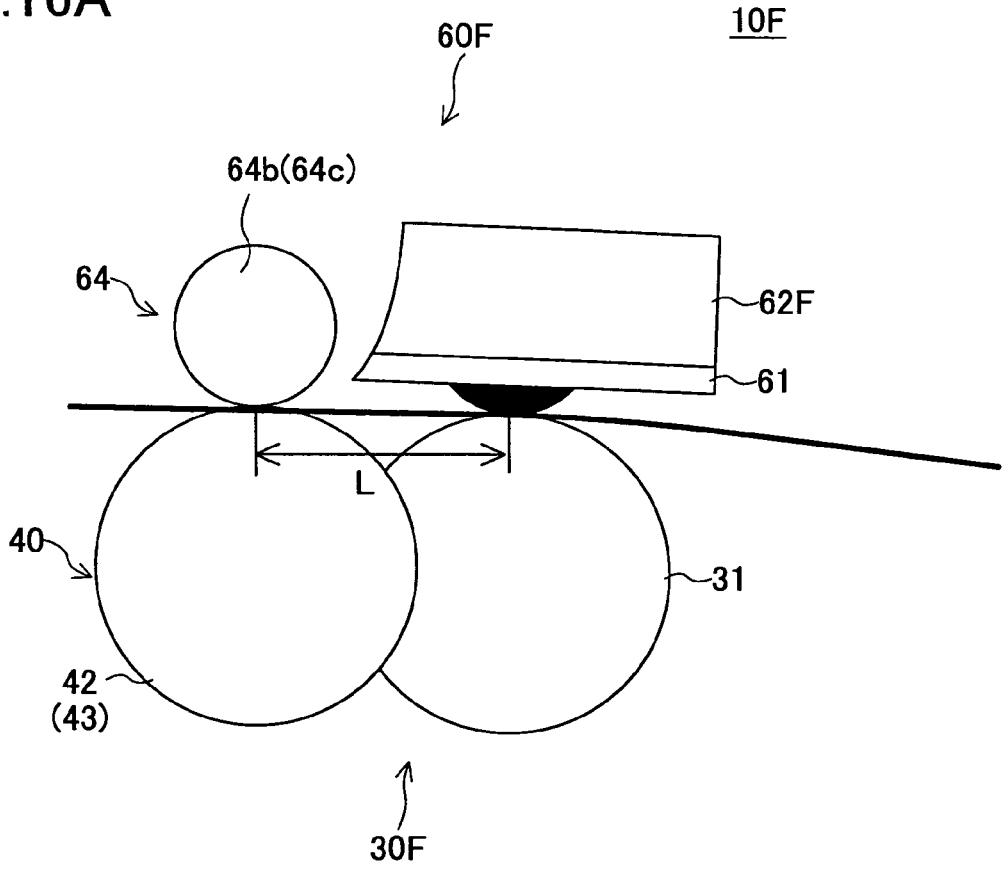
FIGS. 16A and 16B are schematic views showing a thermal printer according to a seventh embodiment of the present invention.
Figure 16B:
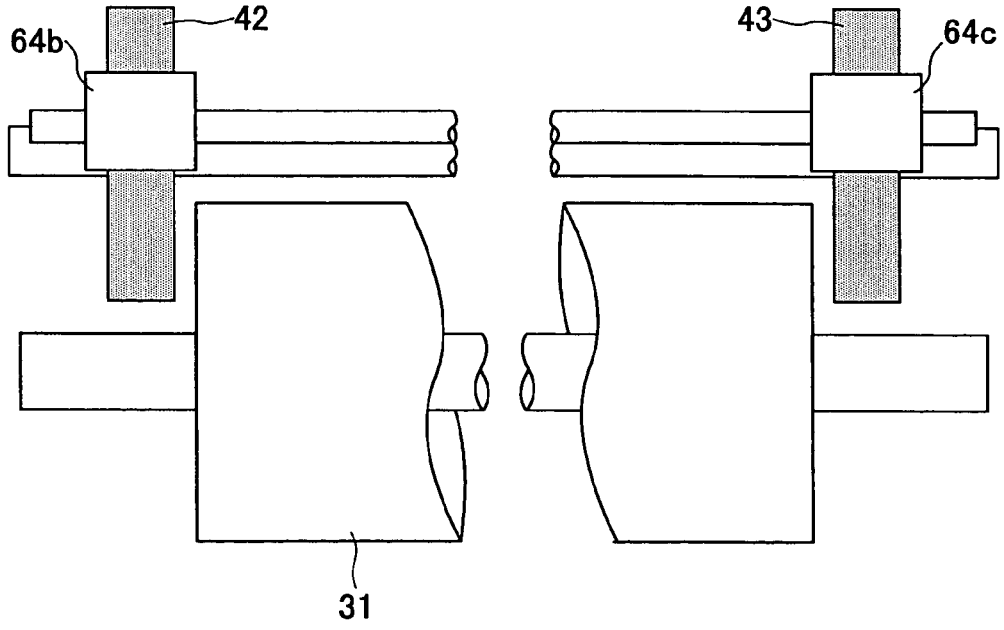

FIGS. 16A and 16B are schematic diagrams showing a thermal printer 10F according to the seventh embodiment of the present invention. A first module 30F includes the platen roller 31 and the grip roller 40. A second module 60F includes the thermal head 61, a head supporting board member 62F, and the pressing roller 64.

The grip roller 40 and the platen roller 31 are disposed in a manner where a portion of the platen roller 31 is fitted between the grip roller part 42 and the grip roller part 43. Accordingly, the length L is short.

[Eighth Embodiment]

Figure 17:
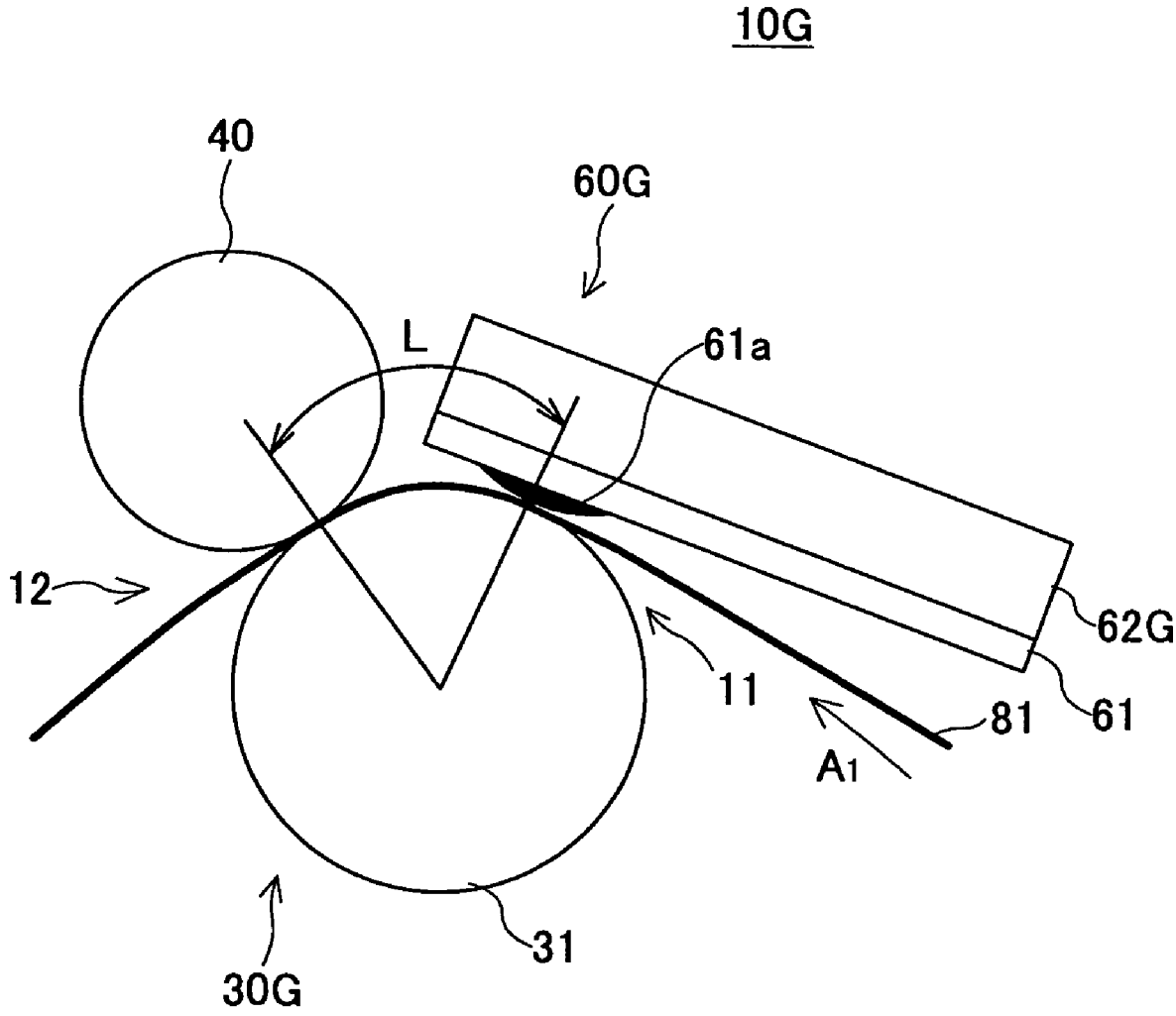
FIG. 17 is a schematic view showing a thermal printer according to an eighth embodiment of the present invention.

FIG. 17 is a schematic diagram showing a thermal printer 10G according to the eighth embodiment of the present invention. A first module 30G includes the platen roller 31. A second module 60G includes the thermal head 61, a head supporting board member 62G, and the grip roller 40. The thermal printer 10G is not provided with the pressing roller 64. The grip roller 40, serving as a part of the second module 60G, is disposed on the same side as the thermal head 61. The platen roller 31, pressing against the thermal head 61, has a part disposed more toward the side A1 compared to the edge (edge toward side A1) of the thermal head 61. The grip roller 40 presses against the part of the platen roller 31 disposed more toward the side A1 compared to the edge (edge toward side A1) of the thermal head 61. The paper 81 is disposed on the peripheral surface of the platen roller 31. Accordingly, the length L is short. In this embodiment, the main paper conveying portion 12 is formed of the grip roller 40 and the platen roller 31.

[Ninth Embodiment]

Figure 18:
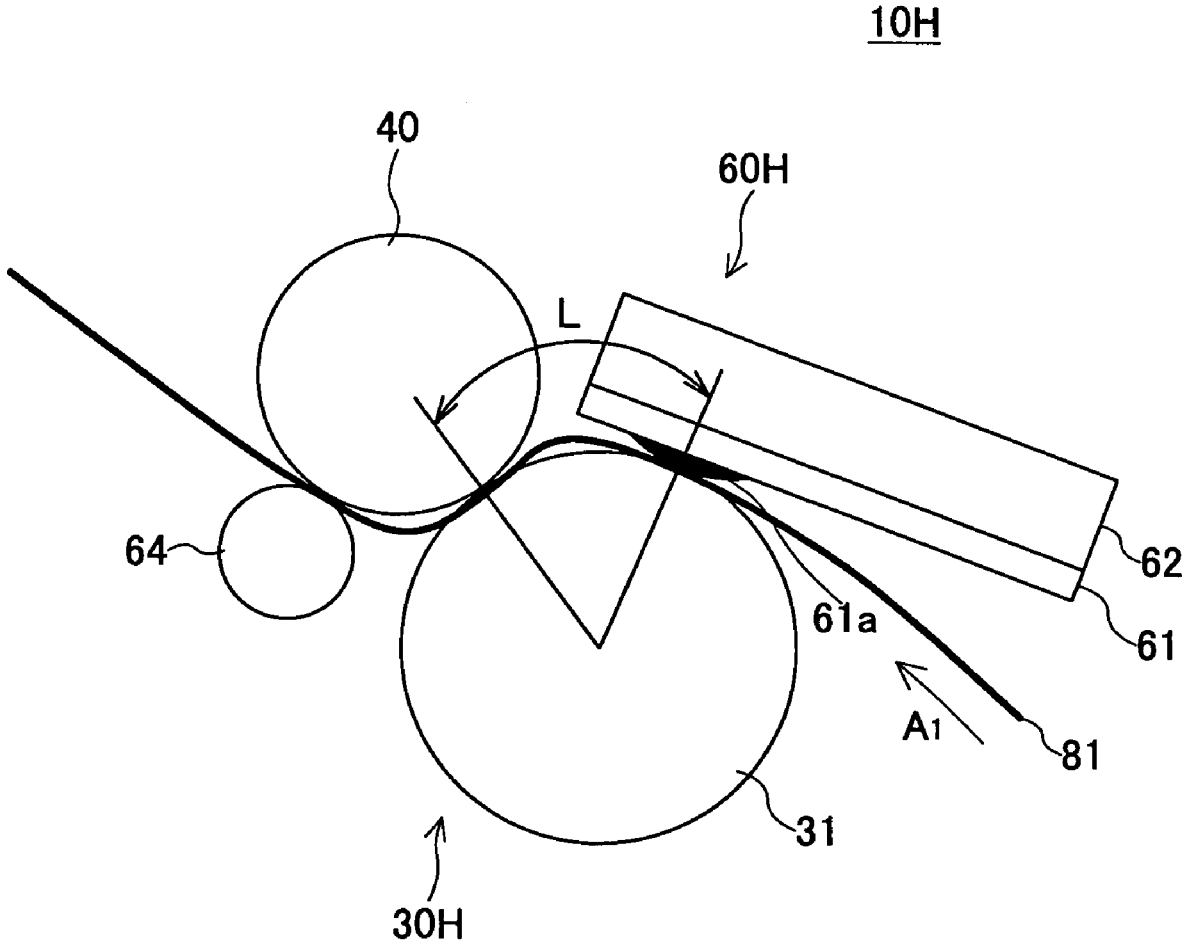
FIG. 18 is a schematic view showing a thermal printer according to a ninth embodiment of the present invention.

FIG. 18 is a schematic diagram showing a thermal printer 10H according to the ninth embodiment of the present invention. A first module 30H includes the platen roller 31 and the pressing roller 64. A second module 60H includes the thermal head 61, a head supporting board member 62H, and the grip roller 40.

The thermal printer 10H has a structure where the thermal printer 10G shown in FIG. 17 is added with the pressing roller 64. The pressing roller 64, serving as a part of the first module 30H, is disposed on the same side as the platen roller 31. The pressing roller 64 is disposed in a manner abutting a lower side of the grip roller 40. The grip roller 40 is separated from the platen roller 31. Accordingly, the length L is short.

Figure 19A:
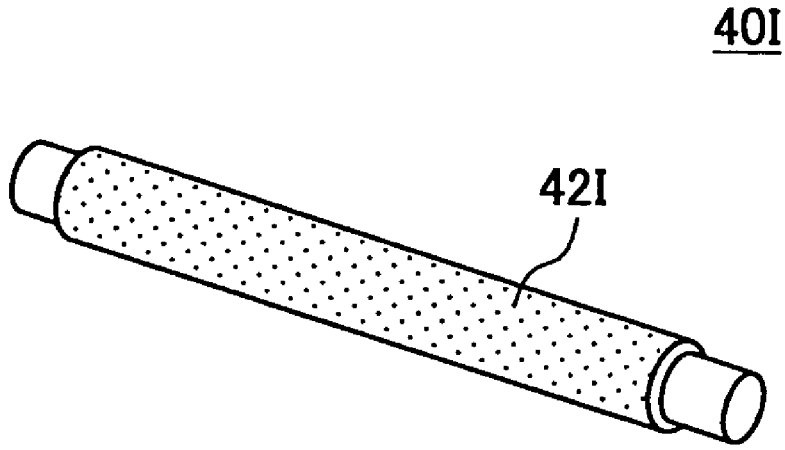
FIGS. 19A and 19B are diagrams showing variations of the grip roller according to an embodiment of the present invention.
Figure 19B:
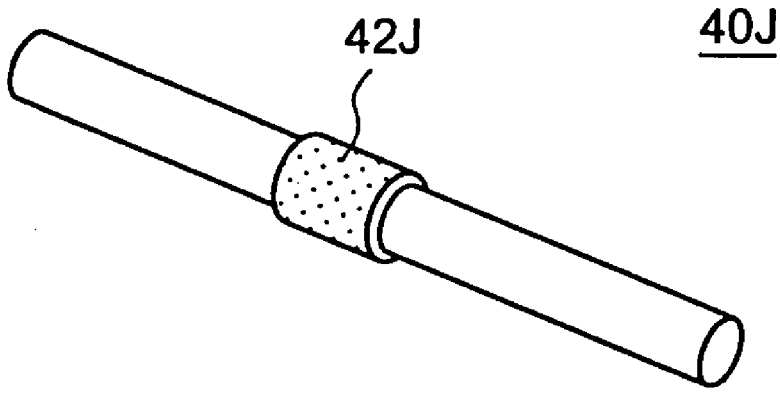

FIGS. 19A and 19B are diagrams showing other exemplary variations of the grip roller 40.

FIG. 19A shows a grip roller 40I in which a grip roller part 42I is disposed across approximately the entire length of the grip roller 40I.

FIG. 19B shows a grip roller 40J in which a grip roller part 42J is disposed at a center of the grip roller 40J.

The grip roller parts 42I, 42J may be formed, for example, by employing a metal mold or by applying paint technology.

In consequence, the printer apparatus according to an exemplary embodiment of the present invention is able to provide a more accurate paper conveying precision and, thereby a more accurate printing precision, in comparison to, for example, a conventional portable printer apparatus conveying paper with a platen roller.

Further, the present invention is not limited to these embodiments, but various variations and modifications may be made without departing from the scope of the present invention.

The present application is based on Japanese priority application No.2003-369318 filed on Oct. 29, 2003, with the Japanese Patent Office, the entire contents of which are hereby incorporated by reference.

What is claimed is:

1. A printer apparatus for printing data on paper traveling through the printer apparatus in a paper conveying direction, the printer apparatus comprising:

a paper conveying portion including a driving roller and a driven roller, the driving roller and driven roller being moveable with respect to one another between an engaged position at which the driving roller and the driven roller are pressed together and a disengaged position at which the driving roller and the driven roller are separated;

a platen member positioned in a manner slightly tilting in a predetermined angle with respect to a line that perpendicularly intersects with center line of a paper conveying path; and a paper guide member situated on one of the sides in the width direction of the printer apparatus so that a rim part of the paper abuts the paper guide member when the paper is conveyed through the platen member, wherein the paper conveying portion is situated downstream, with respect to the paper conveying direction, from the location at which the data is printed on the paper, the driving roller and the driven roller pressingly sandwich the paper therebetween when the driving roller and the driven roller are in the engaged position, the driving roller is configured to rotate in a clockwise direction and a counter-clockwise direction, the driving roller includes a roller part that has a plurality of fine protrusions, disposed on a surface of the roller part, which dig into the paper when the paper is pressingly sandwiched between the driving roller and driven roller, and the height of the fine protrusions is smaller than the thickness of the paper.

2. The printer apparatus as claimed in claim 1, wherein the driving roller includes a roller part disposed at each end thereof.

3. The printer apparatus as claimed in claim 1, wherein the driving roller includes a roller part disposed at the center thereof.

4. The printer apparatus as claimed in claim 1, wherein the driving roller includes a roller part disposed over substantially the entire surface of the driving roller.

5. The printer apparatus as claimed in claim 1, further comprising a printing portion for printing the data on the paper, the printing portion being situated upstream of the paper conveying portion.

6. A printer apparatus for printing data on paper traveling through the printer apparatus in a paper conveying direction, the printer apparatus comprising:

a thermal head;

a platen roller positioned in a manner slightly tilting in a predetermined angle with respect to a line that perpendicularly intersects with center line of a paper conveying path;

a paper guide member situated on one of the sides in the width direction of the printer apparatus so that a rim part of the paper abuts the paper guide member when the paper is conveyed through the platen roller; and a paper conveying portion including a driving roller and a driven roller, the driving roller and driven roller being moveable with respect to one another between an engaged position at which the driving roller and the driven roller are pressed together and a disengaged position at which the driving roller and the driven roller are separated, wherein the thermal head and the platen roller are moveable relative to one another between an engaged position at which the thermal head and the platen roller are pressed together and a disengaged position at which the thermal head and the platen roller are separated, the paper conveying portion is situated downstream, with respect to the paper conveying direction, from the thermal head, the driving roller and the driven roller pressingly sandwich the paper therebetween when the driving roller and the driven roller are in the engaged position, the driving roller is configured to rotate in a clockwise direction and a counter-clockwise direction, the driving roller includes a roller part that has a plurality of fine protrusions, disposed on a surface of the roller part, which dig into the paper when the paper is pressingly sandwiched between the driving roller and driven roller, and the height of the fine protrusions is smaller than the thickness of the paper.

7. The printer apparatus as claimed in claim 6, wherein the platen roller delivers a front-end of the paper by rotation thereof, wherein the driving roller and the driven roller are disposed in the paper conveying portion so that the front-end of the paper, delivered from the thermal head by the rotation of the platen roller, is received between the driving roller and the driven roller, wherein the paper conveying portion conveys the delivered paper once the delivered paper is transferred to the paper conveying portion.

8. The printer apparatus as claimed in claim 6, wherein the driving roller includes a roller part disposed at each end thereof.

9. The printer apparatus as claimed in claim 6, wherein the driving roller includes a roller part disposed at the center thereof.

10. The printer apparatus as claimed in claim 6, wherein the driving roller includes a roller part disposed over substantially the entire surface of the driving roller.

11. The printer apparatus as claimed in claim 6, further comprising:

a motor; and a gear mechanism moved by the motor, the gear mechanism being coupled to the driving roller and the platen roller to rotate the driving roller and the platen roller in the same direction.

12. The printer apparatus as claimed in claim 11, wherein the peripheral velocity of the driving roller is faster than the peripheral velocity of the platen roller.

13. The printer apparatus as claimed in claim 11, further comprising:

a one-way clutch for transmitting rotating motion of the gear mechanism to the platen roller, whereby the platen roller is rotated to thereby move the paper in the paper conveying direction.

14. The printer apparatus as claimed in claim 6, further comprising:

a motor for rotating the driving roller;

a gear disposed at an end of the driving roller;

an oscillatory arm member disposed at an end of the driving roller, and including first and second arm parts pivoting in the same direction as the rotation of the driving roller; and first and second gears disposed on the respective first and second arm parts, which first and second gears engage said gear disposed at the end of the driving roller;

wherein the oscillatory arm member rotates according to the rotation of the driving roller so that the gear of the arm portion engages with the gear disposed on the end of the driving roller.

15. The printer apparatus as claimed in claim 6, wherein:

the driving roller and the platen roller form a first module;

the driven roller and the thermal head form a second module; and the first module and second module are detachably attached, whereby when attached the driving roller and the driven roller are pressed together and the platen roller and the thermal head are pressed together, and when detached the driving roller and the driven roller are separated and the platen roller and the thermal head are separated.

16. The printer apparatus as claimed in claim 6, wherein:

the driven roller and the platen roller form a first module;

the driving roller and the thermal head form a second module; and the first module and second module are detachably attached, whereby when attached the driving roller and the driven roller are pressed together and the platen roller and the thermal head are pressed together, and when detached the driving roller and the driven roller are separated and the platen roller and the thermal head are separated.

17. A printer apparatus for printing data on paper traveling through the printer apparatus in a paper conveying direction, the printer apparatus comprising:

a non-rotating platen pressing against a thermal head;

a platen roller being positioned in a manner slightly tilting in a predetermined angle with respect to a line that perpendicularly intersects with the paper conveying direction;

a paper guide member situated on one of the sides in the width direction of the printer apparatus so that a rim part of the paper abuts the paper guide member when the paper is conveyed through the platen member;

an upstream paper conveying portion being situated upstream, with respect to the paper conveying direction, from the thermal head; and a downstream paper conveying portion being situated downstream, with respect to the paper conveying direction, from the thermal head, the downstream paper conveying portion including a driving roller and a driven roller, the driving roller and driven roller being moveable with respect to one another between an engaged position at which the driving roller and the driven roller are pressed together and a disengaged position at which the driving roller and the driven roller are separated, wherein the driving roller and the driven roller pressingly sandwich the paper therebetween when the driving roller and the driven roller are in the engaged position, the driving roller is configured to rotate in a clockwise direction and a counter-clockwise direction, the driving roller includes a roller part that has a plurality of fine protrusions, disposed on a surface of the roller part, which dig into the paper when the paper is pressingly sandwiched between the driving roller and driven roller, and the height of the fine protrusions is smaller than the thickness of the paper.

18. The printer apparatus as claimed in claim 17, wherein the driving roller includes a roller part disposed at each end thereof.

19. The printer apparatus as claimed in claim 17, wherein the driving roller includes a roller part disposed at the center thereof.

20. The printer apparatus as claimed in claim 17, wherein the driving roller includes a roller part disposed over substantially the entire surface of the driving roller.

* * * * *

UNITED STATES PATENT AND TRADEMARK OFFICE

CERTIFICATE OF CORRECTION

PATENT NO. : 7,213,986 B2
APPLICATION NO. : 10/828238
DATED : May 8, 2007
INVENTOR(S) : Sumio Watanabe et al.

It is certified that error appears in the above-identified patent and that said Letters Patent is hereby corrected as shown below:

Column 12, Line 37, after "with" insert --a--.

Column 13, Line 11, after "with" insert --a--.

Signed and Sealed this

Twenty-first Day of August, 2007

JON W. DUDAS
*Director of the United States Patent and Trademark Office*